US011341892B2

(12) United States Patent
Nomura

(10) Patent No.: US 11,341,892 B2
(45) Date of Patent: May 24, 2022

(54) DISPLAY DRIVER HAVING A CAPACITOR GROUP TO ASSIST DRIVING AN OUTPUT LINE AND ELECTRO-OPTICAL DEVICE THEREOF

(71) Applicant: SEIKO EPSON CORPORATION, Tokyo (JP)

(72) Inventor: Takeshi Nomura, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/003,164

(22) Filed: Aug. 26, 2020

(65) Prior Publication Data

US 2021/0065607 A1 Mar. 4, 2021

(30) Foreign Application Priority Data

Aug. 27, 2019 (JP) ..... JP2019-154192

(51) Int. Cl.
*G09G 3/20* (2006.01)

(52) U.S. Cl.
CPC ... *G09G 3/2007* (2013.01); *G09G 2310/0291* (2013.01)

(58) Field of Classification Search
CPC ..... G09G 3/2007
USPC ..... 345/204
See application file for complete search history.

(56) References Cited

U.S. PATENT DOCUMENTS

2008/0062021 A1 3/2008 Shimatani
2008/0297390 A1* 12/2008 Ko ..... H03M 1/664 341/144
2016/0133218 A1 5/2016 Morita
2016/0133219 A1* 5/2016 Morita ..... G09G 3/3696 345/213
2018/0226047 A1 8/2018 Morita
2019/0088229 A1 3/2019 Morita

FOREIGN PATENT DOCUMENTS

JP 2008-067145 A 3/2008
JP 2016-90881 A 5/2016
JP 2019-056799 A 4/2019

* cited by examiner

*Primary Examiner* — Long D Pham
(74) *Attorney, Agent, or Firm* — Oliff PLC

(57) ABSTRACT

A display driver includes a D/A converter circuit outputting a gradation voltage to an output line based on display data, an assist circuit including a capacitor group and a drive circuit outputting a drive signal group to a first end of the capacitor group based on the display data, the assist circuit being coupled to the output line and configured to perform assist driving of the output line, and an amplifier circuit configured to drive an electro-optical panel. The assist circuit includes an output switch provided between a second end of the capacitor group and the output line, the output switch being ON in an assist period, and an initialization switch including a first end coupled to the second end of the capacitor group and a second end to which an initialization voltage is input, and in an initialization period, the output switch and the initialization switch are ON.

11 Claims, 17 Drawing Sheets

DISPLAY DRIVER HAVING A CAPACITOR GROUP TO ASSIST DRIVING AN OUTPUT LINE AND ELECTRO-OPTICAL DEVICE THEREOF

The present application is based on, and claims priority from JP Application Serial Number 2019-154192, filed Aug. 27, 2019, the disclosure of which is hereby incorporated by reference herein in its entirety.

BACKGROUND

1. Technical Field

The present disclosure relates to a display driver, an electro-optical device, an electronic apparatus, and a mobile body.

2. Related Art

A display device such as a liquid crystal display device is used in various electronic apparatuses such as projectors, information processing devices, and portable information terminals. Such a display device is increasingly becoming high definition, and accordingly the time for the display driver to drive one pixel is getting shorter, and therefore, there is a demand for high-speed driving of the display driver. As a known technique for achieving high-speed driving of a display driver, a technique is disclosed in, for example, JP-A-2016-90881. In JP-A-2016-90881, to achieve high-speed driving of the display driver, an auxiliary voltage setting circuit is provided for the output node of a D/A converter circuit, and the auxiliary voltage setting circuit includes an auxiliary capacitor and a drive circuit that drives one end of the auxiliary capacitor.

In a display driver, a D/A converter circuit selects a gradation voltage corresponding to display data from among a plurality of gradation voltages, and an amplifier circuit outputs a drive voltage corresponding to the selected gradation voltage to an electro-optical panel. Therefore, when attempting to achieve high-speed driving of the display driver, charging and discharging of the gradation voltage lines to which the gradation voltage is supplied will not be completed in time, making it impossible to achieve proper display driving. In addition, it was found that when a voltage corresponding to a data voltage is repeatedly set using the auxiliary capacitor, there is a possibility that the auxiliary voltage of the auxiliary voltage setting circuit may be gradually shifted.

SUMMARY

One aspect of the present disclosure relates to a display driver including a D/A converter circuit configured to output a gradation voltage to an output line on a basis of display data, an assist circuit including a capacitor group and a drive circuit configured to output a drive signal group to a first end of the capacitor group on a basis of the display data, the assist circuit being coupled to the output line and configured to perform assist driving of the output line, and an amplifier circuit configured to drive an electro-optical panel. The assist circuit includes an output switch provided between a second end of the capacitor group and the output line, the output switch being ON in an assist period, and an initialization switch including a first end coupled to the second end of the capacitor group and a second end to which an initialization voltage is input, and in an initialization period, the output switch and the initialization switch are ON.

DESCRIPTION OF EXEMPLARY EMBODIMENTS

An embodiment will be described below. Note that the embodiment described below is not intended to limit the disclosure of the claims. In addition, all of the configurations described in the embodiment may not necessarily be essential elements.

1. Basic Configuration Example of Display Driver

Figure 1:
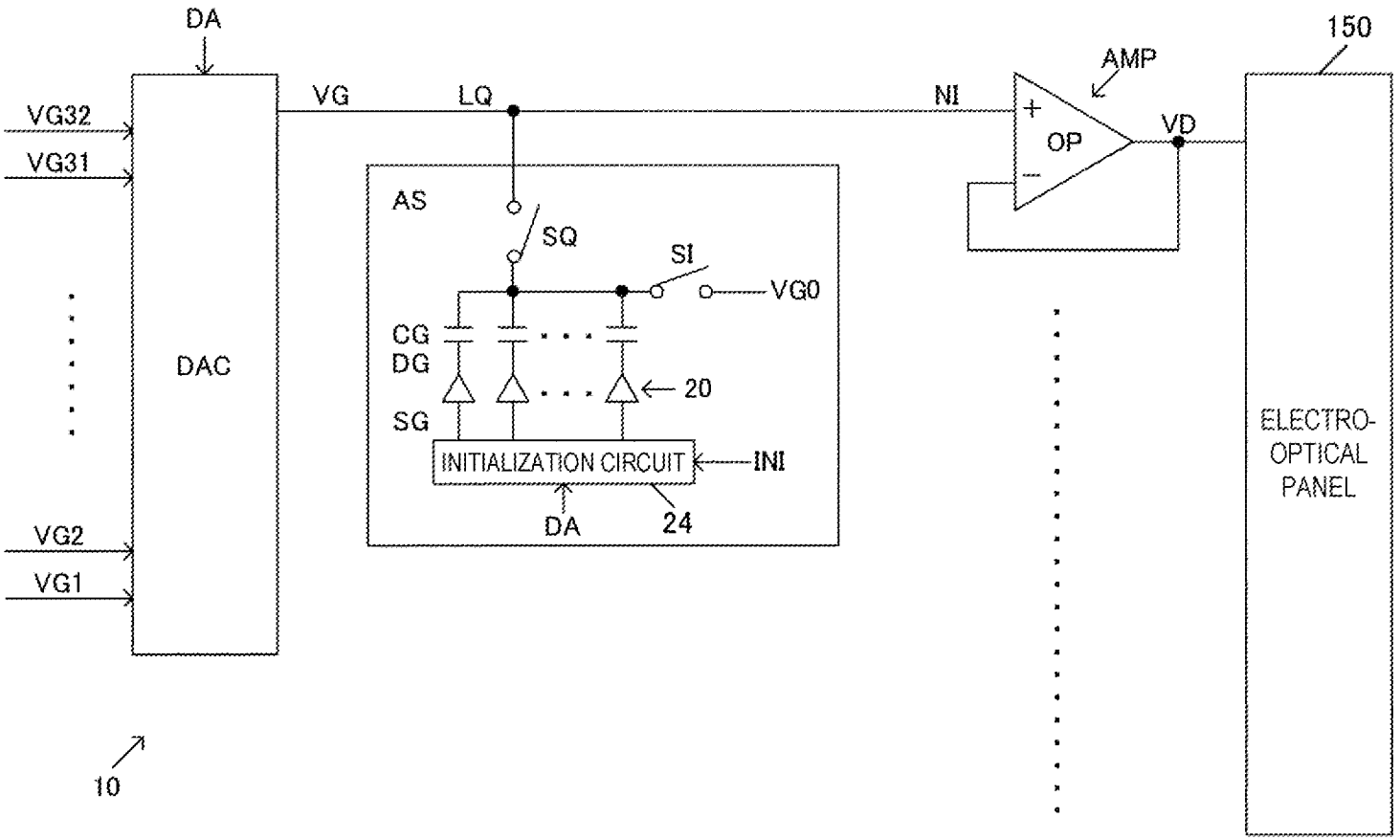
FIG. 1 illustrates a basic configuration example of a display driver of an embodiment.
Figure 2:
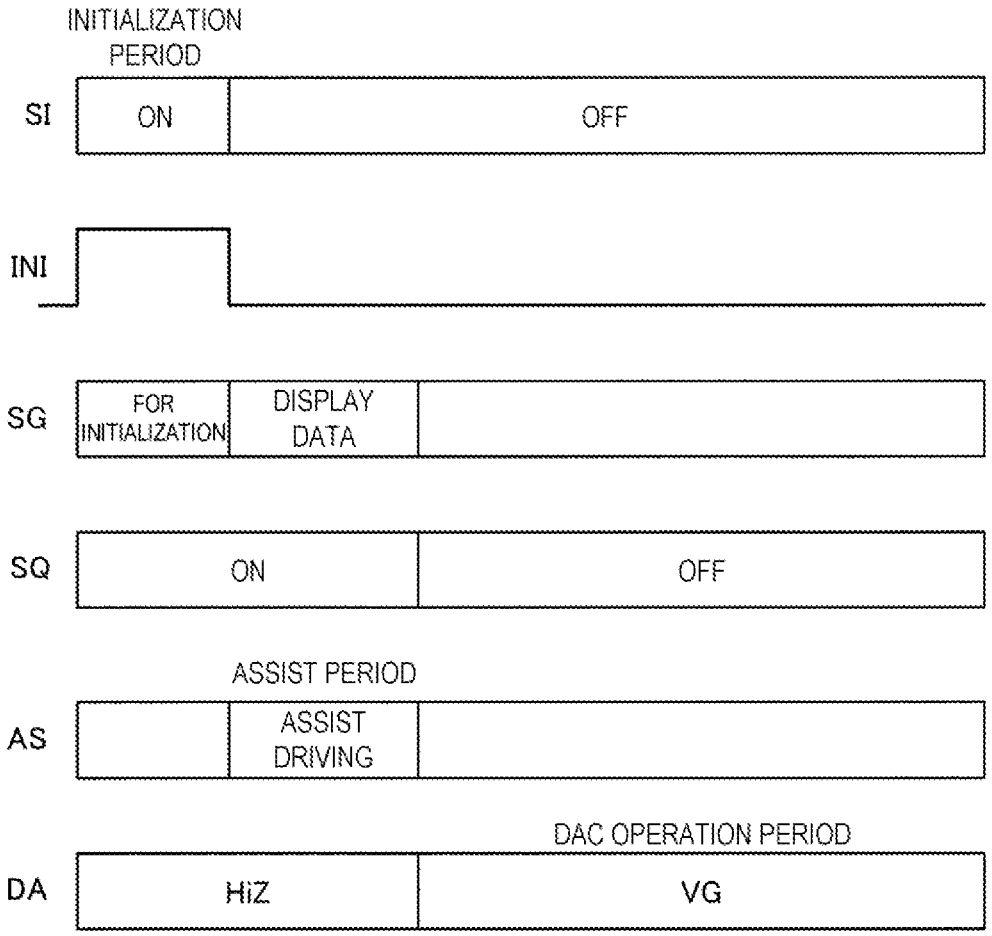
FIG. 2 is an explanatory diagram of an operation of the display driver.

FIG. 1 illustrates a basic configuration example of a display driver 10 of the embodiment, and FIG. 2 is an explanatory diagram of an operation of the display driver 10. The display driver 10 includes a D/A converter circuit DAC, an assist circuit AS, and an amplifier circuit AMP.

The D/A converter circuit DAC outputs a gradation voltage VG to an output line LQ on the basis of display data DA. Specifically, the D/A converter circuit DAC outputs, to the output line LQ, the gradation voltage VG selected based on the display data DA from among a plurality of gradation voltages VG1 to VG32. For example, the D/A converter circuit DAC includes a plurality of switching elements that are turned on and off on the basis of each bit data of the display data DA and selects a gradation voltage corresponding to the display data DA from among the plurality of gradation voltages VG1 to VG32 in a manner called a tournament method.

The assist circuit AS includes a capacitor group CG and a drive circuit 20 that outputs a drive signal group DG to one end of the capacitor group CG. The assist circuit AS is coupled to the output line LQ to perform assist driving of the output line LQ. The assist driving performed by the assist circuit AS is preliminary driving for bringing the voltage of the output line LQ of the D/A converter circuit DAC closer to the desired voltage corresponding to the display data DA through charge redistribution using the capacitor group CG. For example, when the drive circuit 20 drives one end of the capacitor group CG with the drive signal group DG corresponding to the display data DA in the state where charge is accumulated in the capacitor of the capacitor group CG, the voltage of the output line LQ is brought closer to the gradation voltage VG corresponding to the display data DA, and thus high-speed driving of the display driver 10 is achieved.

The amplifier circuit AMP drives the electro-optical panel 150. The amplifier circuit AMP is composed of, for example, an operational amplifier OP. For example, the amplifier circuit AMP outputs, as a drive voltage VD, a voltage obtained by buffering the voltage input to an input node NI. For example, the amplifier circuit AMP is a circuit configured with a voltage follower connection of the operational amplifier OP. Note that the amplifier circuit AMP may be composed of an operational amplifier OP of an inverting type. The output node of the amplifier circuit AMP is electrically coupled to the data line of the electro-optical panel 150 through the output terminal of the display driver 10 and the input terminal of the electro-optical panel 150. In this manner, the drive voltage VD of the amplifier circuit AMP can be used to drive the pixel electrode of the electro-optical panel 150, and the image display using the electro-optical panel 150 can be achieved.

As illustrated in FIG. 1, the assist circuit AS includes an output switch SQ and an initialization switch SI. The output switch SQ is provided between the other end of the capacitor group CG and the output line LQ, and is turned on in the assist period of the assist circuit AS, as illustrated in FIG. 2. At this time, the output of the D/A converter circuit DAC is set to a high impedance state. The drive signal group DG from the drive circuit 20 is input to one end of the capacitor group CG. After the output switch SQ is turned off, the D/A converter circuit DAC outputs the gradation voltage VG to the output line LQ. Specifically, in a DAC operation period after the output switch SQ is switched from on to off, the D/A converter circuit DAC outputs a voltage selected based on the display data DA from among the VG1 to VG32 to the output line LQ as the gradation voltage VG.

In addition, the other end of the capacitor group CG is coupled to one end of the initialization switch SI, and the initialization voltage VG0 is input to the other end of the initialization switch SI. The initialization switch SI can be achieved with a CMOS transistor or the like. As illustrated in FIG. 2, when the initialization switch SI is turned on in the initialization period, the other end of the capacitor group CG is set to the initialization voltage VG0. Specifically, in the embodiment, the output switch SQ and the initialization switch SI are turned on in the initialization period. As a result, the output line LQ is set to the initialization voltage VG0 through the output switch SQ and the initialization switch SI that are turned on.

As described above, in the embodiment, in the initialization period, the output switch SQ and the initialization switch SI are turned on, the other end of the capacitor group CG is set to the initialization voltage VG0, and the output line LQ is set to the initialization voltage VG0. Thus, after the output line LQ is set to the initialization voltage VG0 in the initialization period, the assist circuit AS can perform assist driving in the assist period. Specifically, in the initialization period, the output line LQ is set to the initialization voltage VG0, and from the state where the output line LQ is set to the initialization voltage VG0 as described above, the assist circuit AS performs the assist driving for bringing the voltage of the output line LQ closer to the gradation voltage VG output by the D/A converter circuit DAC. In this manner, even in the case where the assist driving is repeatedly performed, the assist circuit AS can perform the assist driving with the initialization voltage VG0 as the starting voltage at all times. For example, the gate capacitance as the parasitic capacitance of the output line LQ has voltage-dependence, and the gate capacitance as the parasitic capacitance fluctuates in accordance with the voltage of the output line LQ. As such, when the assist driving is performed with a different voltage as the starting voltage, there is a possibility that the assist voltage of the assist circuit AS is shifted. In this regard, in the embodiment, the assist driving is performed with the initialization voltage VG0 as the starting voltage. Thus, even in the case where the assist driving of the assist circuit AS is repeatedly performed many times, a situation in which the assist voltage of the assist circuit AS is gradually shifted can be prevented. In addition, it suffices that the assist circuit AS performs assist driving of changing the voltage of the output line LQ from the initialization voltage VG0 to a voltage on the high potential side or the low potential side, and thus the assist driving is simplified.

In addition, in the embodiment, in the initialization period, the output of the D/A converter circuit DAC is set to a high impedance state. For example, when the switching element that constitutes the D/A converter circuit DAC is turned off, the output of the D/A converter circuit DAC is set to a high impedance state. For example, in the display driver of the above-described JP-A-2016-90881, the output of the D/A converter circuit is not set to a high impedance state, and the D/A converter circuit outputs a gradation voltage corresponding to the display data at all times. In contrast, in the embodiment, the output of the D/A converter circuit DAC is set to a high impedance state in the initialization period as illustrated in FIG. 2. In this manner, the D/A converter circuit DAC does not output the gradation voltage VG to the output line LQ in the initialization period, and thus the output line LQ can be properly set to the initialization voltage VG0. Then, the assist circuit AS can properly execute the assist driving of the output line LQ with the initialization voltage VG0 as the starting voltage.

In addition, in the embodiment, after the initialization period, the initialization switch SI is turned off, and after the assist driving of the output line LQ is performed by the assist circuit AS in the assist period, the output switch SQ is turned off. Specifically, as illustrated in FIG. 2, after the initialization period, the initialization switch SI is turned off, and accordingly the supply of the initialization voltage VG0 to the other end of the capacitor group CG is stopped. Then, in this state, the assist circuit AS performs the assist driving using the capacitor group CG, and thereafter the output switch SQ is turned off. In this manner, after the initialization period, the initialization switch SI is turned off such that the initialization voltage VG0 is not supplied to the other end of the capacitor group CG. Then, the assist circuit AS performs assist driving, and, after the assist period, the output switch SQ is turned off, and thus, the assist driving of the output line LQ by the assist circuit AS can be stopped.

In addition, in the embodiment, after the output switch SQ is turned off, the D/A converter circuit DAC outputs the gradation voltage VG to the output line LQ. Specifically, as illustrated in FIG. 2, the initialization process is performed in which the output line LQ is set to the initialization voltage VG0 in the state where the output switch SQ is on, and the assist driving is performed by the assist circuit AS. Thereafter, the output switch SQ is switched from on to off, and the D/A converter circuit DAC outputs the gradation voltage VG to the output line LQ. In this manner, in the initialization period, the output line LQ is set to the initialization voltage VG0, and the assist circuit AS performs the assist driving based on the display data DA with the initialization voltage VG0 as the starting voltage, and as a result, the voltage of the output line LQ is brought closer to the gradation voltage VG. Thereafter, when the D/A converter circuit DAC outputs the gradation voltage VG to the output line LQ, the electro-optical panel 150 can be driven by the drive voltage VD corresponding to the gradation voltage VG, and thus high-speed driving of the display driver 10 is achieved.

In addition, in the embodiment, the assist circuit AS includes an initialization circuit 24. As illustrated in FIG. 2, the initialization circuit 24 outputs a control signal group SG for initialization to the drive circuit 20 in the initialization period. Then, in the assist period, the control signal group SG corresponding to the display data DA is output to the drive circuit 20. For example, in the initialization period, when an initialization signal INI is activated as illustrated in FIG. 2, the initialization circuit 24 outputs the control signal group SG for initialization to the drive circuit 20. For example, the initialization circuit 24 outputs the control signal group SG that initializes the drive signal group DG output by the drive circuit 20 to, for example, a low level voltage. In this manner, in the initialization period, when the initialization circuit 24 outputs the control signal group SG for initialization to the drive circuit 20, the drive circuit 20 can output a drive signal group DG for initialization to one end of the capacitor group CG. Then, the initialization circuit 24 outputs the control signal group SG corresponding to the display data DA to the drive circuit 20 in the assist period after the initialization period. In this manner, the drive circuit 20 outputs the drive signal group DG corresponding to the display data DA to one end of the capacitor group CG, and assist driving of increasing the voltage of the output line LQ from the initialization voltage VG0 to a voltage corresponding to the display data DA can be achieved.

Note that the initialization circuit 24 may output the control signal group SG that initializes the drive signal group DG output by the drive circuit 20 to a high level voltage. In this case, the assist circuit AS performs assist driving of reducing the voltage of the output line LQ from the initialization voltage VG0 to a voltage corresponding to the display data DA.

Figure 3:
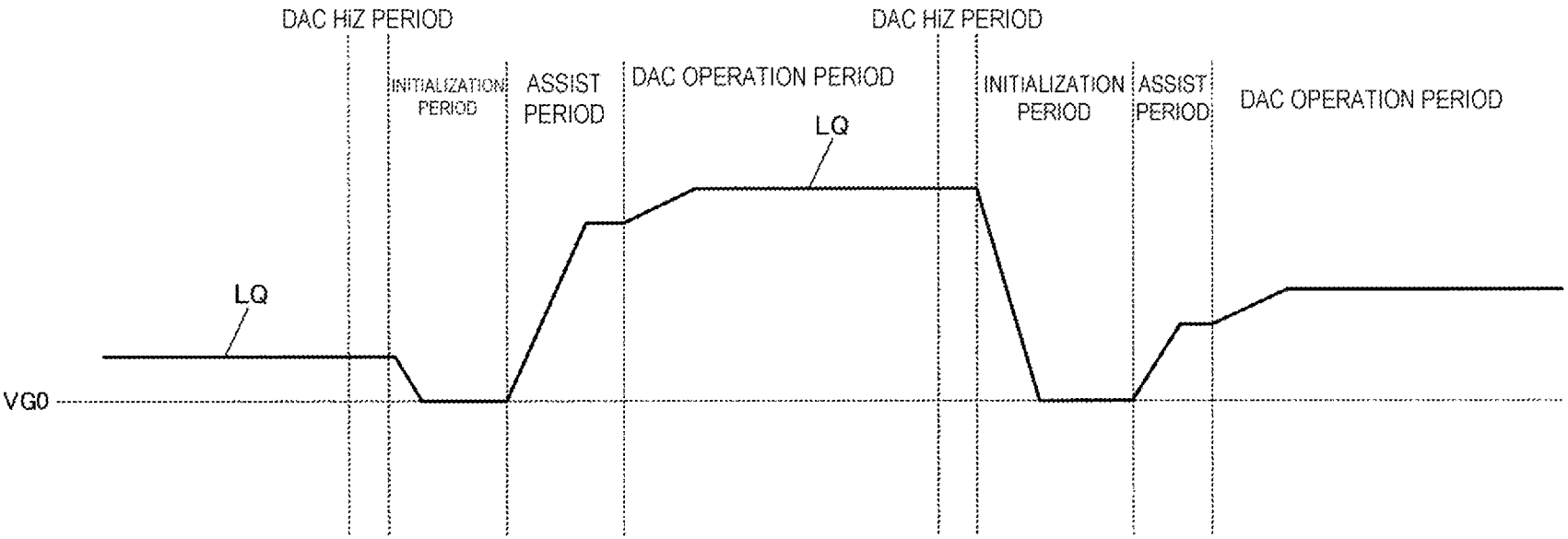
FIG. 3 is a signal waveform diagram for describing an operation of the display driver.

FIG. 3 is a signal waveform diagram for describing an operation of the display driver 10. First, the output of the D/A converter circuit DAC is set to a high impedance state. Then, in the initialization period, the output line LQ is set to the initialization voltage VG0. Specifically, when the output switch SQ and the initialization switch SI are turned on, the output line LQ is set to the initialization voltage VG0. At this time, the initialization circuit 24 outputs the control signal group SG that initializes the drive signal group DG to the low level voltage. Thereafter, the assist driving is performed by the assist circuit AS. Specifically, the assist circuit AS performs assist driving of increasing the voltage of the output line LQ from the initialization voltage VG0 to the voltage on the high potential side. Note that the initialization circuit 24 may output the control signal group SG that initializes the drive signal group DG to the high level voltage in the initialization period, and the assist circuit AS may perform assist driving of reducing the voltage of the output line LQ from the initialization voltage VG0 to the voltage on the low potential side in the assist period. Then, after the assist period, the D/A converter circuit DAC is operated and the DAC driving is performed. Specifically, the DAC driving of setting the voltage of the output line LQ to the gradation voltage VG corresponding to the display data DA is performed. After such a DAC operation period, the output of the D/A converter circuit DAC is set to a high impedance state. Then, in the initialization period, the voltage of the output line LQ is set to the initialization voltage VG0. Specifically, the voltage of the output line LQ is set to the same initialization voltage VG0 as that of the previous initialization period. Thereafter, the assist driving of increasing the voltage of the output line LQ from the initialization voltage VG0 to the voltage on the high potential side is performed by the assist circuit AS. Since this assist driving is performed on the basis of the display data DA, the voltage of the output line LQ set by the assist driving is different from that of the previous assist period. Then, after the assist period, the DAC driving of setting the voltage of the output line LQ to the gradation voltage VG corresponding to the display data DA is performed by the D/A converter circuit DAC.

As described above, in the embodiment, in each initialization period, the voltage of the output line LQ is set to the initialization voltage VG0 of the same voltage, and thereafter the assist driving is performed with the initialization voltage VG0 as the starting voltage. In this manner, the proper assist driving can be maintained even in the case where the assist driving is repeatedly performed.

While hereafter a case where the display driver 10 performs a positive polarity driving and a negative polarity driving is mainly described, the embodiment is not limited thereto. The method of the embodiment can be applied also to a driving method in which the positive polarity driving and the negative polarity driving are not performed. For example, the configuration and operation of each circuit of the display driver 10 described in FIGS. 4 to 16 can also be applied to a driving method in which the positive polarity driving and the negative polarity driving are not performed. In addition, an assist circuit ASAM for the amplifier circuit described in FIG. 15 can be applied not only to the display driver 10 having the detailed configuration example illustrated in FIG. 15, but also to the display driver 10 having the configuration illustrated in FIGS. 1, 4, and 11. In addition, the assist circuit ASAM for the amplifier circuit can also be applied to the display driver 10 having a configuration in which the initialization of the output line LQ described in FIGS. 1 to 3 is not performed.

2. Configuration Example of Display Driver

Figure 4:
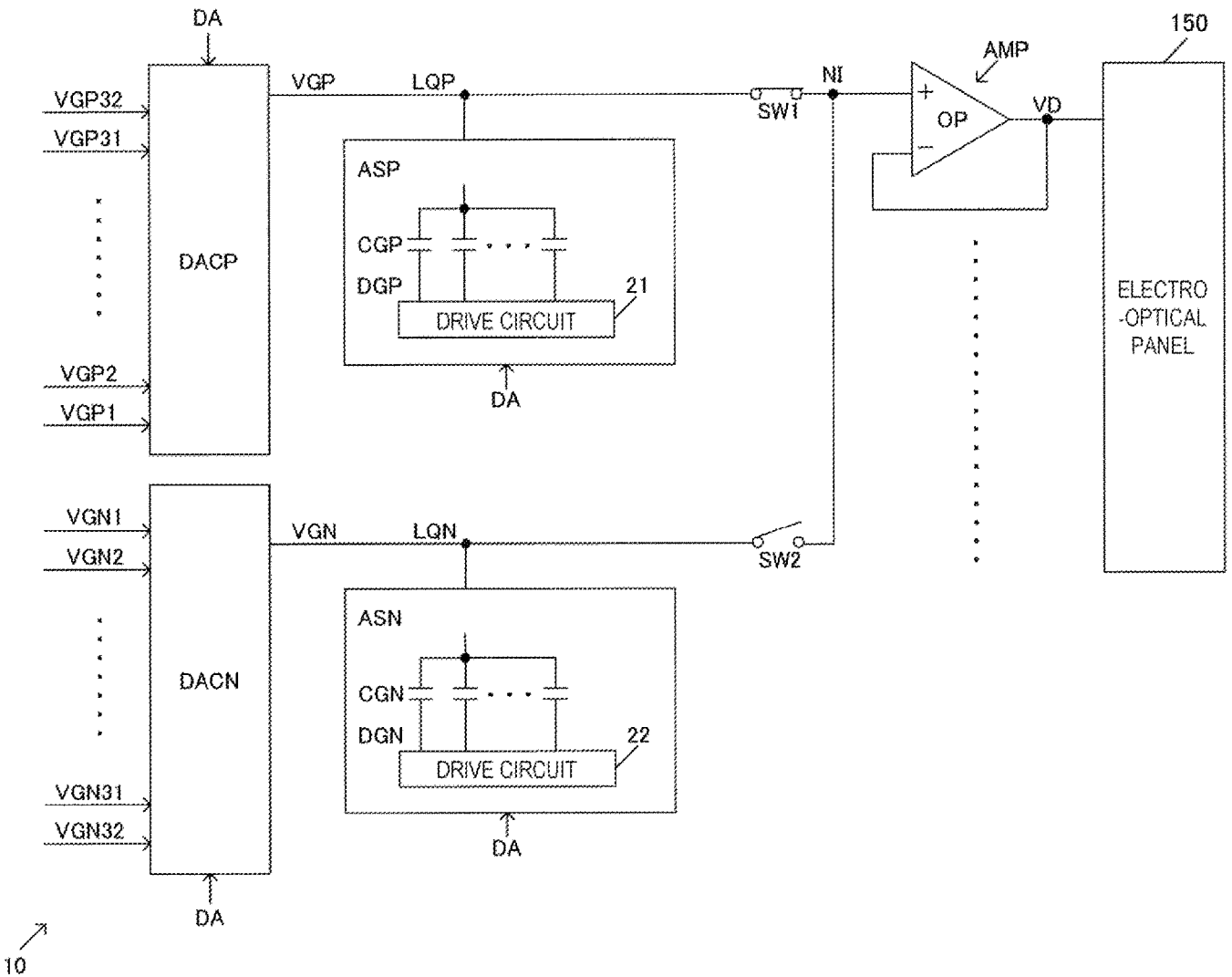
FIG. 4 illustrates a configuration example of a display driver of an embodiment.

FIG. 4 illustrates a configuration example of the display driver 10 of the embodiment. The display driver 10 includes D/A converter circuits DACP and DACN, assist circuits ASP and ASN, an amplifier circuit AMP, and switches SW1 and SW2. The display driver 10 drives the electro-optical panel 150. The DACP is a first D/A converter circuit, the DACN is a second D/A converter circuit, the ASP is a first assist circuit, the ASN is a second assist circuit, the SW1 is a first switch, and the SW2 is a second switch.

The electro-optical panel 150 is a panel for displaying images, and can be achieved with a liquid crystal panel, an organic EL panel or the like, for example. The electro-optical panel 150 may also be referred to as a display panel. An active-matrix panel that uses a switching element such as a thin film transistor (TFT) can be employed as the liquid crystal panel. Specifically, the electro-optical panel 150 includes a plurality of pixels. For example, a plurality of pixels disposed in a matrix are provided. In addition, the electro-optical panel 150 includes a plurality of data lines and a plurality of scan lines laid in a direction that intersects the plurality of data lines. Each of the plurality of pixels is disposed in a region where each data line and each scan line intersect each other. In the case of an active-matrix panel, a switching element such as a thin film transistor is disposed in the region of each pixel. The electro-optical panel 150 achieves a display operation by changing the optical property of the electro-optical element in the region of each pixel. The electro-optical element is a liquid crystal element, an EL element, or the like. Note that in the case of an organic EL panel, a pixel circuit for current-driving the EL element with is disposed in the region of each pixel.

The D/A converter circuit DACP outputs a gradation voltage VGP for the positive polarity to the output line LQP on the basis of the display data DA. The output line LQP is a first output line. Specifically, the D/A converter circuit DACP outputs, to the output line LQP, a gradation voltage VGP selected based on the display data DA from among the plurality of gradation voltages VGP1 to VGP32 for the positive polarity. For example, the D/A converter circuit DACP includes a plurality of switching elements that are turned on and off on the basis of each bit data of the display data DA, and selects a gradation voltage corresponding to the display data DA from among the plurality of gradation voltages VGP1 to VGP32 in a manner called a tournament method. The gradation voltage for the positive polarity is a gradation voltage on the high potential side with respect to a voltage serving as the common.

The D/A converter circuit DACN outputs a gradation voltage VGN for the negative polarity to the output line LQN on the basis of the display data DA. The output line LQN is a second output line. Specifically, the D/A converter circuit DACN outputs, to the output line LQN, the gradation voltage VGN selected based on the display data DA from among the plurality of gradation voltages VGN1 to VGN32 for the negative polarity. For example, the D/A converter circuit DACN includes a plurality of switching elements that are turned on and off based on each bit data of the display data DA, and selects a gradation voltage corresponding to the display data DA from among the plurality of gradation voltages VGN1 to VGN32 in a manner called a tournament method. The gradation voltage for the negative polarity is a gradation voltage on the low potential side with respect to a voltage serving as the common. While FIG. 4 illustrates an example in which the gradation number of each of the positive polarity and the negative polarity is 32, the gradation number may be less than 32 or greater than 32.

The assist circuit ASP includes a capacitor group CGP and a drive circuit 21 that outputs a drive signal group DGP to one end of the capacitor group CGP. The assist circuit ASP is coupled to the output line LQP to perform assist driving of the output line LQP. The capacitor group CGP is a first capacitor group, the drive circuit 21 is a first drive circuit, and the drive signal group DGP is a first drive signal group. The capacitor group CGP composed of a plurality of auxiliary capacitors is provided between the output line LQP and the drive circuit 21. For example, one end of the capacitor group CGP is coupled to an output node of the drive circuit 21, and the other end of the capacitor group CGP is electrically coupled to the output line LQP through a circuit element such as, for example, an output switch described below. The assist driving performed by the assist circuit ASP is preliminary driving for bringing the voltage of the output line LQP of the D/A converter circuit DACP closer to the desired voltage corresponding to the display data DA through charge redistribution using the capacitor group CGP. For example, when the drive circuit 21 drives one end of the capacitor group CGP with the drive signal group DGP corresponding to the display data DA in the state where the charge has accumulated in the capacitor of the capacitor group CGP, the voltage of the output line LQP is brought closer to the gradation voltage VGP corresponding to the display data DA, and thus high-speed driving of the display driver 10 is achieved.

The assist circuit ASN includes a capacitor group CGN and a drive circuit 22 that outputs a drive signal group DGN to one end of the capacitor group CGN. The assist circuit ASN is coupled to the output line LQN to perform assist driving of the output line LQN. The capacitor group CGN is a second capacitor group, the drive circuit 22 is a second drive circuit, and the drive signal group DGN is a second drive signal group. The capacitor group CGN composed of the plurality of auxiliary capacitors is provided between the output line LQN and the drive circuit 22. For example, one end of the capacitor group CGN is coupled to an output node of the drive circuit 22, and the other end of the capacitor group CGN is electrically coupled to the output line LQN through a circuit element such as, for example, an output switch described later. The assist driving performed by the assist circuit ASN is preliminary driving for bringing the voltage of the output line LQN of the D/A converter circuit DACN closer to the desired voltage corresponding to the display data DA through charge redistribution using the capacitor group CGN. For example, when the drive circuit 22 drives one end of the capacitor group CGN with the drive signal group DGN corresponding to the display data DA in the state where the charge has accumulated in the capacitor of the capacitor group CGN, the voltage of the output line LQN is brought closer to the gradation voltage VGN corresponding to the display data DA, and thus high-speed driving of the display driver 10 is achieved.

The amplifier circuit AMP drives the electro-optical panel 150. The amplifier circuit AMP is composed of, for example, an operational amplifier OP. For example, the amplifier circuit AMP outputs, as a drive voltage VD, a voltage obtained by buffering the voltage input to an input node NI.

The switch SW1 is provided between the output line LQP and the input node NI of the amplifier circuit AMP, and is turned on in the positive polarity period. The switch SW1 is a first switch. The switch SW1 can be achieved with, for example, a CMOS transistor. The switch SW1 may be, for example, a transfer gate composed of a P-type transistor and an N-type transistor. The positive polarity period is a period in which the display driver 10 drives the electro-optical panel 150 using the gradation voltages VGP1 to VGP32 for the positive polarity.

The switch SW2 is provided between the output line LQN and the input node NI of the amplifier circuit AMP, and is turned on in the negative polarity period. The switch SW2 is a second switch. The switch SW2 can be achieved with, for example, a CMOS transistor. The switch SW2 may be, for example, a transfer gate composed of a P-type transistor and an N-type transistor. The negative polarity period is a period in which the display driver 10 drives the electro-optical panel 150 using the gradation voltages VGN1 to VGN32 for the negative polarity.

Figure 5:
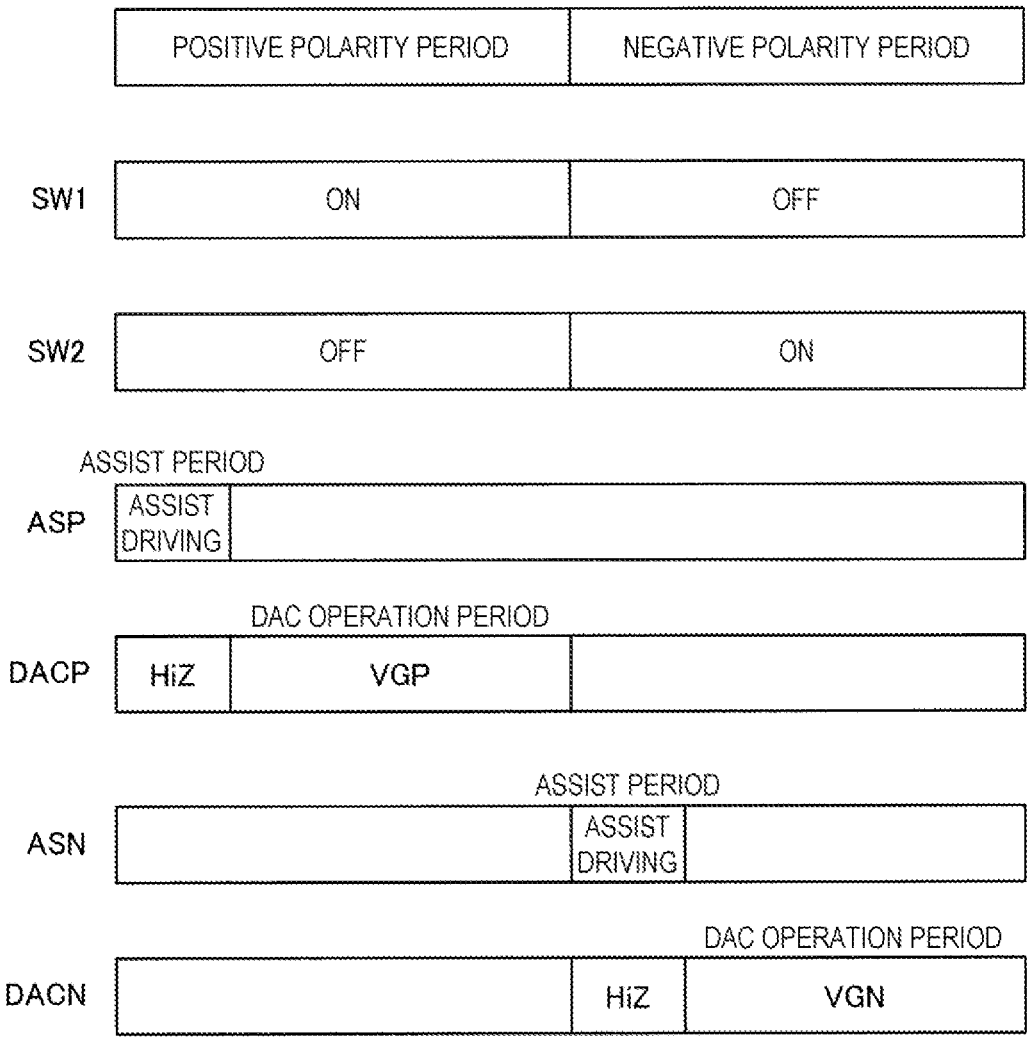
FIG. 5 is an explanatory diagram of an operation of the display driver.

FIG. 5 is an explanatory diagram of an operation of the display driver 10 of the embodiment. As illustrated in FIG. 5, in the positive polarity period, the switch SW1 is turned on and the switch SW2 is turned off. As a result, the output line LQP for the positive polarity is coupled to the input node NI of the amplifier circuit AMP, and the output line LQN for the negative polarity is discoupled from the input node NI. Then, the assist circuit ASP performs assist driving in the assist period in the positive polarity period. For example, in the assist period, which is a period of the front half of the positive polarity period, the assist circuit ASP performs assist driving of bringing the voltage of the output line LQP closer to the gradation voltage VGP, which is a voltage corresponding to the display data DA. In this assist period, the output of the D/A converter circuit DACP is set to a high impedance state. For example, the output of the D/A converter circuit DACP is set to a high impedance state when the switching element that constitutes the D/A converter circuit DACP is turned off. Then, after the assist period, the D/A converter circuit DACP outputs the gradation voltage VGP for the positive polarity to the output line LQP. The amplifier circuit AMP drives the electro-optical panel 150 by outputting a drive voltage VD corresponding to the gradation voltage VGP for the positive polarity to the electro-optical panel 150. Thus, the positive polarity driving of the electro-optical panel 150 is achieved.

In addition, as illustrated in FIG. 5, the switch SW2 is turned on and the switch SW1 is turned off in the negative polarity period. As a result, the output line LQN for the negative polarity is coupled to the input node NI of the amplifier circuit AMP, and the output line LQP for the positive polarity is discoupled from the input node NI. The assist circuit ASN performs assist driving in the assist period in the negative polarity period. For example, in the assist period, which is a period of the front half of the negative polarity period, the assist circuit ASN performs assist driving of bringing the voltage of the output line ASN closer to the gradation voltage VGN, which is a voltage corresponding to the display data DA. In this assist period, the output of the D/A converter circuit DACN is set to a high impedance state. For example, the output of the D/A converter circuit DACN is set to a high impedance state when the switching element that constitutes the D/A converter circuit DACN is turned off. Then, after the assist period, the D/A converter circuit DACN outputs the gradation voltage VGN for the negative polarity to the output line LQN. Then, the amplifier circuit AMP drives the electro-optical panel 150 by outputting the drive voltage VD corresponding to the gradation voltage VGN for the negative polarity to the electro-optical panel 150. Thus, the negative polarity driving of the electro-optical panel 150 is achieved.

As described above, in the embodiment, in the positive polarity period, the switch SW1 is turned on and the switch SW2 is turned off, and, after the assist circuit ASP performs the assist driving of the output line LQP, the D/A converter circuit DACP outputs the gradation voltage VGP for the positive polarity to the output line LQP. In addition, in the negative polarity period, the switch SW1 is turned off and the switch SW2 is turned on, and, after the assist circuit ASN performs the assist driving of the output line LQN, the D/A converter circuit DACN outputs the gradation voltage VGN for the negative polarity to the output line LQN.

In this manner, in the positive polarity period, the D/A converter circuit DACP outputs the gradation voltage VGP for the positive polarity to the output line LQP after the voltage of the output line LQP is brought closer to the gradation voltage VGP for the positive polarity through the assist driving for the positive polarity by the assist circuit ASP, and thus the electro-optical panel 150 can be driven by the drive voltage VD corresponding to the gradation voltage VGP. In addition, in the negative polarity period, the D/A converter circuit DACN outputs the gradation voltage VGN for the negative polarity to the output line VGN after the voltage of the output line LQN is brought closer to the gradation voltage VGN for the negative polarity through the assist driving for the negative polarity by the assist circuit ASN, and thus the electro-optical panel 150 can be driven by the drive voltage VD corresponding to the gradation voltage VGN. Thus, the positive polarity driving and negative polarity driving of the electro-optical panel 150 can be achieved while performing the assist driving by the assist circuits ASP and ASN.

In addition, in the embodiment, in the assist period in which the assist circuit ASP performs the assist driving, the output of the D/A converter circuit DACP is set to a high impedance state. In addition, in the assist period in which the assist circuit ASN performs the assist driving, the output of the D/A converter circuit DACN is set to a high impedance state. In the display driver of the above-described JP-A-2016-90881, the D/A converter circuit outputs a voltage even in the assist period, whereas, in the embodiment, the output of the D/A converter circuits DACP and DACN is set to a high impedance state in the assist period. In this manner, a situation where the output voltage of the D/A converter circuits DACP and DACN affects the assist driving of the assist circuits ASP and ASN in the assist period can be prevented, and proper assist driving can be achieved. In addition, after the assist period, the D/A converter circuits DACP and DACN output the gradation voltages VGP and VGN corresponding to the display data DA, and thus the voltages of the output lines LQP and LQN brought closer to the gradation voltages VGP and VGN can be set to the correct gradation voltages VGP and VGN.

Figure 6:
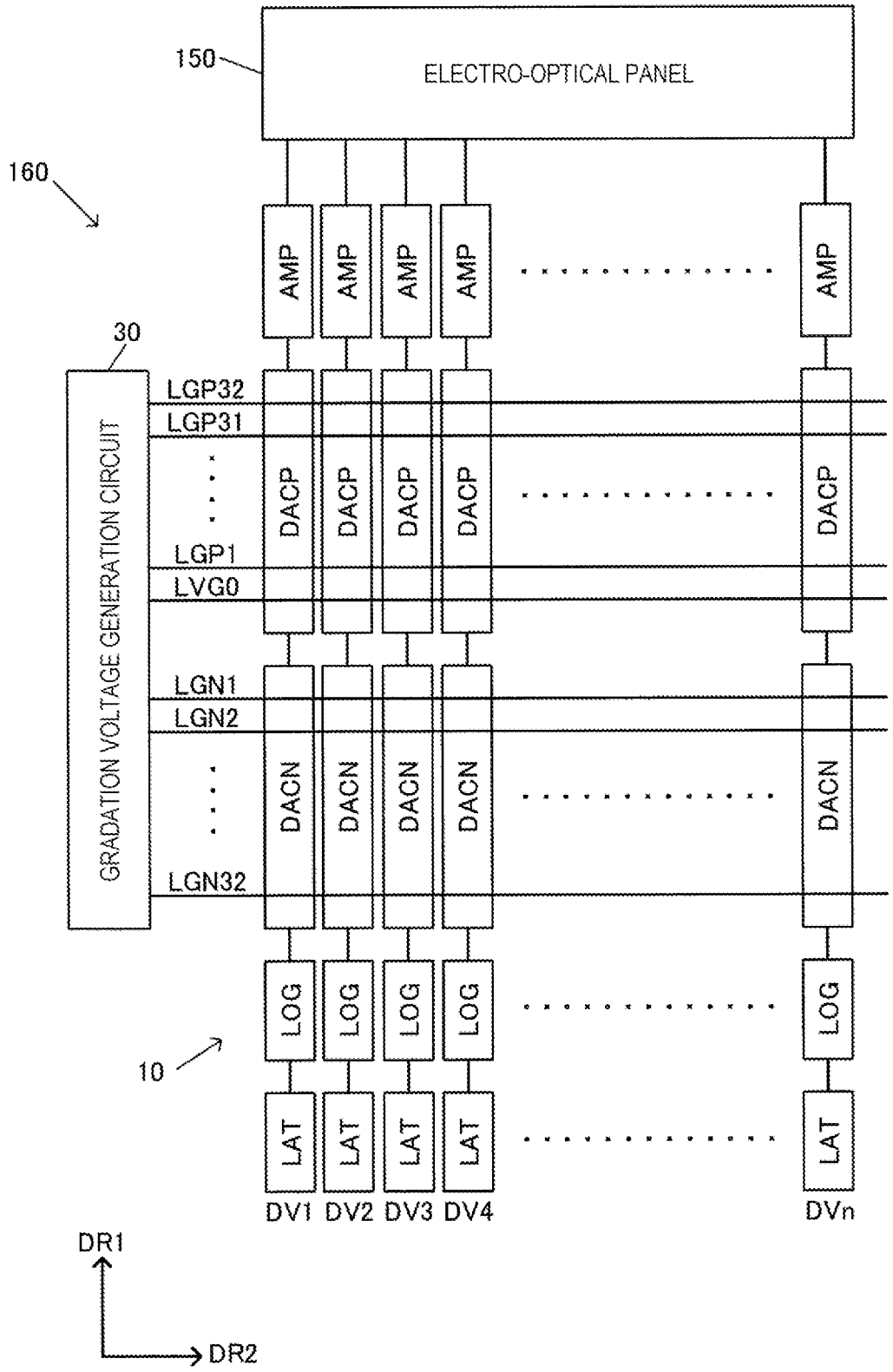
FIG. 6 is a diagram illustrating an example of an entire configuration of the display driver.

FIG. 6 illustrates an example of an entire configuration of the display driver 10 of the embodiment. The electro-optical device 160 of the embodiment is composed of the display driver 10 and the electro-optical panel 150.

As illustrated in FIG. 6, the display driver 10 includes a plurality of driver circuits DV1, DV2, DV3, DV4 . . . DVn (where n is a positive integer) and a gradation voltage generation circuit 30. Each of the driver circuits DV1 to DVn includes the amplifier circuit AMP described in FIG. 4, the D/A converter circuits DACP and DACN, a logic circuit LOG, a latch circuit LAT, and switches SW1 and SW2, which are not illustrated in FIG. 6. When the long side direction of the driver circuits DV1 to DVn is set as a direction DR1, the driver circuits DV1 to DVn are disposed side by side along a direction DR2 that is orthogonal to the direction DR1. The direction DR1 is a direction from the display driver 10 toward the electro-optical panel 150.

The gradation voltage generation circuit 30 generates the gradation voltages VGP1 to VGP32 for the positive polarity and outputs them to the gradation voltage lines LGP1 to LGP32. In addition, the gradation voltage generation circuit 30 generates the gradation voltages VGN1 to VGN32 for the negative polarity and outputs them to the gradation voltage lines LGN1 to LGN32. As illustrated in FIG. 6, the gradation voltage lines LGP1 to LGP32 and LGN1 to LGN32 are laid on the driver circuits DV1 to DVn along the direction DR2. For example, the gradation voltage generation circuit 30 includes a ladder resistance circuit, and outputs the gradation voltages VGP1 to VGP32 and VGN1 to VGN32 generated at voltage division nodes of the ladder resistance circuit to gradation voltage lines LGP1 to LGP32 and LGN1 to LGN32. Note that the gradation voltage generation circuit 30 also generates an initialization voltage (described later), and outputs it to an initialization voltage line LVG0. The initialization voltage is, for example, a voltage between the gradation voltage VGP1, which has a lowest voltage among the gradation voltages VGP1 to VGP32 for the positive polarity, and the gradation voltage VGN1, which has a highest voltage among the gradation voltages VGN1 to VGN32 for the negative polarity.

Figure 7:
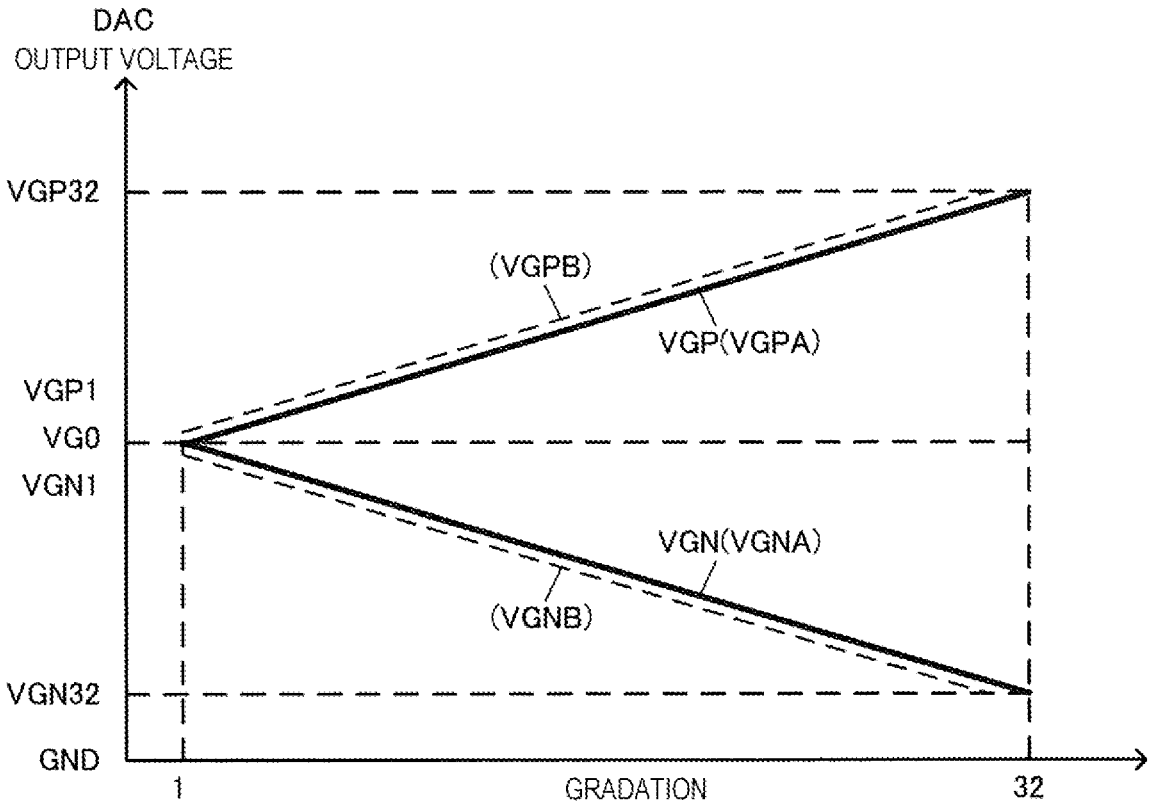
FIG. 7 is an explanatory diagram of a gradation voltage.

FIG. 7 is an explanatory diagram of a gradation voltage. As illustrated in FIG. 7, in the gradation voltages VGP1 to VGP32 for the positive polarity, the greater the gradation, the greater the voltage. In the gradation voltages VGN1 to VGN32 for the negative polarity, the greater the gradation, the smaller the voltage. In addition, in the embodiment, as the initialization voltage described later, a VG0 corresponding to the boundary voltage of the gradation voltage range for the positive polarity and the gradation voltage range for the negative polarity is used. As an example, VGP32=12.5V, VG0=7.5V, and VGN32=2.5V.

In the detailed example of the display driver 10 of the embodiment described later, the amplifier circuit AMP outputs a drive voltage VD corresponding to the gradation voltage between the first gradation voltage and the second gradation voltage on the basis of the lower bit data of the display data DA. The first gradation voltage and the second gradation voltage are adjacent gradation voltages. On the positive polarity side, the VGPA in FIG. 7 corresponds to the first gradation voltage, and the VGPB corresponds to the second gradation voltage. On the negative polarity side, the VGNA corresponds to the first gradation voltage, and the VGNB corresponds to the second gradation voltage.

Figure 8:
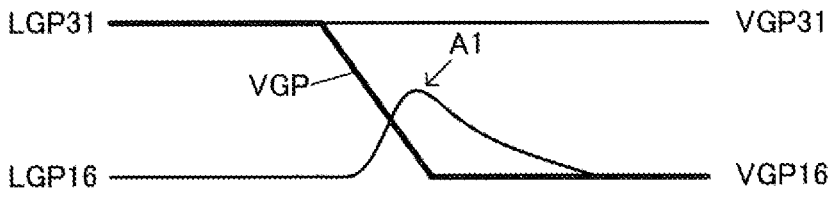
FIG. 8 is an explanatory diagram of a problem of charging and discharging of a gradation voltage line.

FIG. 8 is an explanatory diagram of a problem of charging and discharging of a gradation voltage line. In FIG. 8, as the display data DA changes, the output voltage of the D/A converter circuit DACP changes from VGP31 to VGP16. At this time, such a voltage change does not cause a serious problem when the voltage change occurs in one driver circuit of the DV1 to DVn in FIG. 6; however, a problem occurs when the voltage change occurs in a large number of driver circuits. For example, the drain capacitance, wiring capacitance, and the like of the switching element of the D/A converter circuit DACP become the parasitic capacitance of the gradation voltage line LGP31, and the charge resulting from the voltage of the VGP31 is accumulated in the parasitic capacitance. As such, when the voltage change as illustrated in FIG. 8 occurs in a large number of driver circuits in the DV1 to DVn, the charge accumulated in the parasitic capacitance of the gradation voltage line LGP31 flows into the gradation voltage line LGP16, and consequently large voltage fluctuations indicated as A1 are caused in the gradation voltage line LGP16. With only the driving capability of the D/A converter circuit DACP, it is difficult to suppress such large voltage fluctuations, resulting in a hindrance to high-speed driving of the display driver 10. Therefore, it is necessary to achieve assist driving that can appropriately cope with the large voltage fluctuations.

In addition, a high voltage is required to drive the electro-optical panel 150, and it is therefore necessary to use a high-voltage-withstanding transistor as the transistor that constitutes the circuit of the display driver 10. For example, a high-voltage-withstanding transistor is required if a gradation voltage in the voltage range of 12.5V to 2.5V corresponding to the voltage range of VGP32 to VGN32 of FIG. 7 is used to drive the electro-optical panel 150, for example. However, since the layout area of a high-voltage-withstanding transistor is large, the circuit area of the display driver 10 significantly increases if the circuit of the display driver 10 is formed with only such a high-voltage-withstanding transistor.

In this regard, in the embodiment, the D/A converter circuit DACP for the positive polarity, the D/A converter circuit DACN for the negative polarity, and the switches SW1 and SW2 are provided as illustrated in FIG. 4 such that the output voltages of the D/A converter circuits DACP and DACN are sequentially input to the amplifier circuit AMP using the switches SW1 and SW2. For example, the output voltage of the D/A converter circuit DACP for the positive polarity is input to the amplifier circuit AMP through the switch SW1 in the positive polarity period, and the output voltage of the D/A converter circuit DACN for the negative polarity is input to the amplifier circuit AMP through the switch SW2 in the negative polarity period. Further, in the embodiment, the assist circuit ASP for the positive polarity coupled to the output line LQP of the D/A converter circuit DACP, and the assist circuit ASN for the negative polarity coupled to the output line LQN of the D/A converter circuit DACN are provided. In this manner, the output voltage of the D/A converter circuit DACP can be input to the amplifier circuit AMP through the switch SW1 after the assist driving is performed by the assist circuit ASP in the positive polarity driving, and the output voltage of the D/A converter circuit DACN can be input to the amplifier circuit AMP through the switch SW2 after the assist driving is performed by the assist circuit ASN in the negative polarity driving. Thus, even in the case where the driving is performed such that the positive polarity driving and the negative polarity driving alternate, it is possible to achieve assist driving that can suitably cope with the large voltage fluctuations in the gradation voltage line illustrated in FIG. 8.

In addition, by providing the display driver 10 with the circuit configuration illustrated in FIG. 4, the D/A converter circuits DACP and DACN can be composed of a first voltage-withstanding transistor, and the amplifier circuit AMP, the assist circuits ASP and ASN, and the switches SW1 and SW2 can be composed of a second voltage-withstanding transistor whose breakdown voltage is higher than that of the first voltage-withstanding transistor, for example. For example, the D/A converter circuits DACP and DACN are composed of the first voltage-withstanding transistor whose breakdown voltage is a middle voltage of approximately 8V, for example. On the other hand, the amplifier circuit AMP, the assist circuits ASP and ASN, and the switches SW1 and SW2 are composed of the second voltage-withstanding transistor whose breakdown voltage is a high voltage of approximately 12.5V or higher, for example. With such a configuration, the circuit area of the display driver 10 can be greatly reduced in comparison with the case where all of the circuits of the display driver 10 are composed of the second voltage-withstanding transistor that is a high-voltage-withstanding transistor. For example, the D/A converter circuits DACP and DACN are composed of a large number of switching elements corresponding to the number of bits of the display data DA, and have a large circuit area, and therefore when the D/A converter circuits DACP and DACN are composed of the second voltage-withstanding transistor whose breakdown voltage is high, the circuit area becomes very large. In this regard, in the embodiment, the D/A converter circuits DACP and DACN can be composed of the first voltage-withstanding transistor whose breakdown voltage is lower than that of the second voltage-withstanding transistor, and thus the circuit area of the display driver 10 can be greatly reduced.

Figure 9:
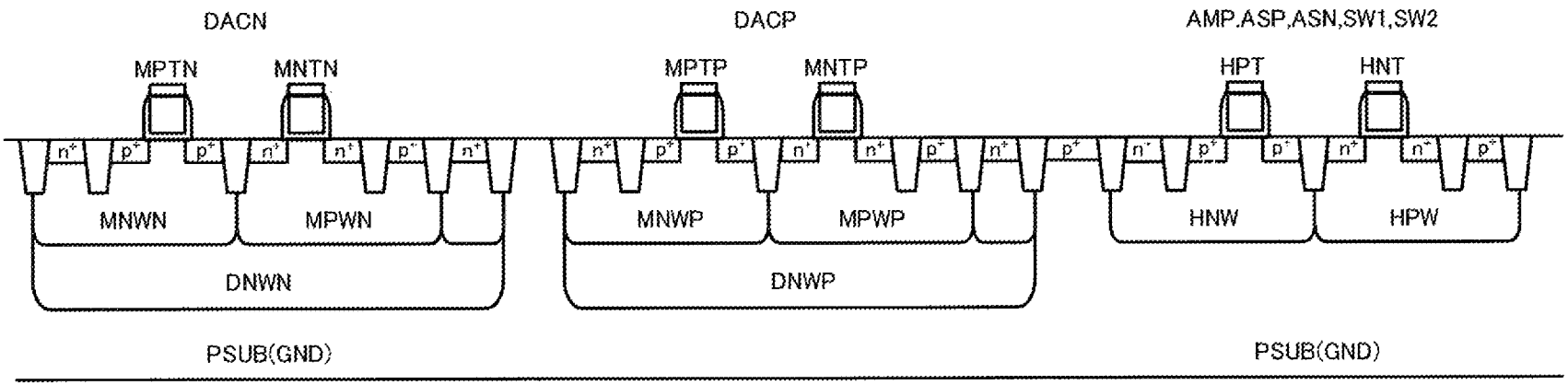
FIG. 9 is a cross-sectional view illustrating an example of a triple-well structure in which a first voltage-withstanding transistor and a second voltage-withstanding transistor are formed.

FIG. 9 is a cross-sectional view illustrating an example of a triple-well structure in which the first voltage-withstanding transistor and the second voltage-withstanding transistor are formed. For example, in FIG. 9, the D/A converter circuit DACP is composed of an N-type first voltage-withstanding transistor MNTP or a P-type first voltage-withstanding transistor MPTP. The D/A converter circuit DACN is composed of an N-type first voltage-withstanding transistor MNTN and/or a P-type first voltage-withstanding transistor MPTN. On the other hand, the amplifier circuit AMP, the assist circuits ASP and ASN, and the switches SW1 and SW2 are composed of an N-type second voltage-withstanding transistor HNT and/or a P-type second voltage-withstanding transistor HPT.

In the triple-well structure of FIG. 9, a plurality of N-type deep wells DNWP and DNWN are formed at a P-type substrate PSUB. The deep wells DNWP and DNWN are N-type embedded layers formed at the P-type substrate PSUB, for example. Further, a P-type well MPWP and an N-type well MNWP are formed in the N-type deep well DNWP, an N-type first voltage-withstanding transistor MNTP is formed in the P-type well MPWP, and a P-type first voltage-withstanding transistor MPTP is formed in the N-type well MNWP. The first voltage-withstanding transistors MNTP and MPTP are middle voltage-withstanding transistors, and the D/A converter circuit DACP is composed of the first voltage-withstanding transistors MNTP and MPTP. In addition, a P-type well MPWN and an N-type well MNWN are formed in the N-type deep well DNWN, an N-type first voltage-withstanding transistor MNTN is formed in the P-type well MPWN, and a P-type first voltage-withstanding transistor MPTN is formed in the N-type well MNWN. The first voltage-withstanding transistors MNTN and MPTN are middle voltage-withstanding transistors, and the D/A converter circuit DACN is composed of the first voltage-withstanding transistors MNTN and the MPTN.

On the other hand, an N-type second voltage-withstanding transistor HNT is formed in a high-breakdown voltage P-type well HPW formed in the substrate PSUB. In addition, a P-type second voltage-withstanding transistor HPT is formed in a high-breakdown voltage N-type well HNW formed in the substrate PSUB. The second voltage-withstanding transistors HNT and HPT are high-voltage-withstanding transistors, and the amplifier circuit AMP, the assist circuits ASP and ASN, and the switches SW1 and SW2 are composed of the second voltage-withstanding transistors HNT and the HPT.

With the deep well structure illustrated in FIG. 9, transistors with different breakdown voltages, such as the first voltage-withstanding transistors MNTP, MPTP, MNTN, and MPTN, and the second voltage-withstanding transistors HNT and HPT, can be formed in the substrate PSUB. In addition, by forming the N-type deep wells DNWP and DNWN separated on the substrate PSUB, it is possible to make the voltage range of the first voltage-withstanding transistors MNTP and MPTP for the positive polarity, and the voltage range of the first voltage-withstanding transistors MNTN and MPTN for the negative polarity different from each other.

Figure 10:
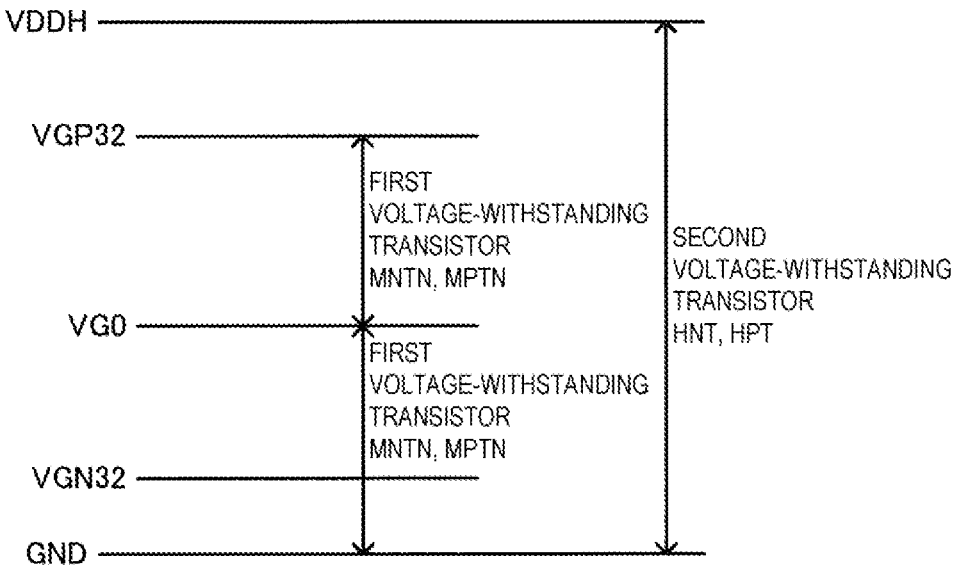
FIG. 10 is an explanatory diagram of a voltage range of the first voltage-withstanding transistor and the second voltage-withstanding transistor.

FIG. 10 is an explanatory diagram of a voltage range of the first voltage-withstanding transistor and the second voltage-withstanding transistor. As illustrated in FIG. 10, the voltage range of the first voltage-withstanding transistors MNTP and MPTP for the positive polarity is from the VGP32 to the VG0, and the voltage range of the first voltage-withstanding transistors MNTN and MPTN for the negative polarity is from the VG0 to the GND, that is, the voltage ranges are different from each other. The VGP32 is a high potential voltage in the positive polarity driving in the positive polarity period and is the highest gradation voltage in the positive polarity period. The voltage range of the first voltage-withstanding transistors MNTP and MPTP falls within the voltage range between the VGP32 and the VG0. The VGN32 is a high potential voltage in the negative polarity driving in the negative polarity period, and is the lowest gradation voltage in the negative polarity period. The voltage range of the first voltage-withstanding transistors MNTN and the MPTN falls within the voltage range between the VG0 and the GND, which is lower than the VGN32. The VG0 corresponds to the initialization voltage described later, and is an intermediate voltage between the VGP32, which is a high potential voltage in the positive polarity driving in the positive polarity period, and the VGN32, which is a low potential voltage in the negative polarity driving in the negative polarity period.

On the other hand, the voltage range of the second voltage-withstanding transistors HNT and the HPT is from VDDH to GND. The VDDH is a voltage greater than the VGP32 and is the highest voltage of the voltage used by the display driver 10.

As illustrated in FIGS. 9 and 10, by configuring the D/A converter circuits DACP and DACN with the first voltage-withstanding transistor MNTP, MPTP, MNTN, and MPTN whose breakdown voltage is lower than that of the second voltage-withstanding transistors HNT and HPT, the circuit area of the D/A converter circuits DACP and DACN can be greatly reduced. Since the circuit area of the D/A converter circuits DACP and DACN is large, the circuit area of the display driver 10 can be efficiently reduced by using the first voltage-withstanding transistors MNTP, MPTP, MNTN, and MPTN, which can reduce the area, instead of using the second voltage-withstanding transistors HNT and the HPT with a high-breakdown voltage, which increase the area.

In addition, by employing the triple-well structure illustrated in FIG. 9, the D/A converter circuit DACP on the positive polarity side can be composed of the first voltage-withstanding transistors MNTP and MPTP having a voltage range of the VGP32 to the VG0, and the D/A converter circuit DACN on the negative polarity side can be composed of the first voltage-withstanding transistors MNTN and MPTN having a voltage range of the VG0 to the GND. With the D/A converter circuit DACP on the positive-polarity side composed of the first voltage-withstanding transistors MNTP and MPTP of the first voltage range, and the D/A converter circuit DACN on the negative polarity side composed of the first voltage-withstanding transistors MNTN and MPTN of the second voltage range different from the first voltage range, the D/A converter circuits DACP and DACN can be configured without using high-voltage-withstanding transistors, and the circuit area can be reduced.

Figure 11:
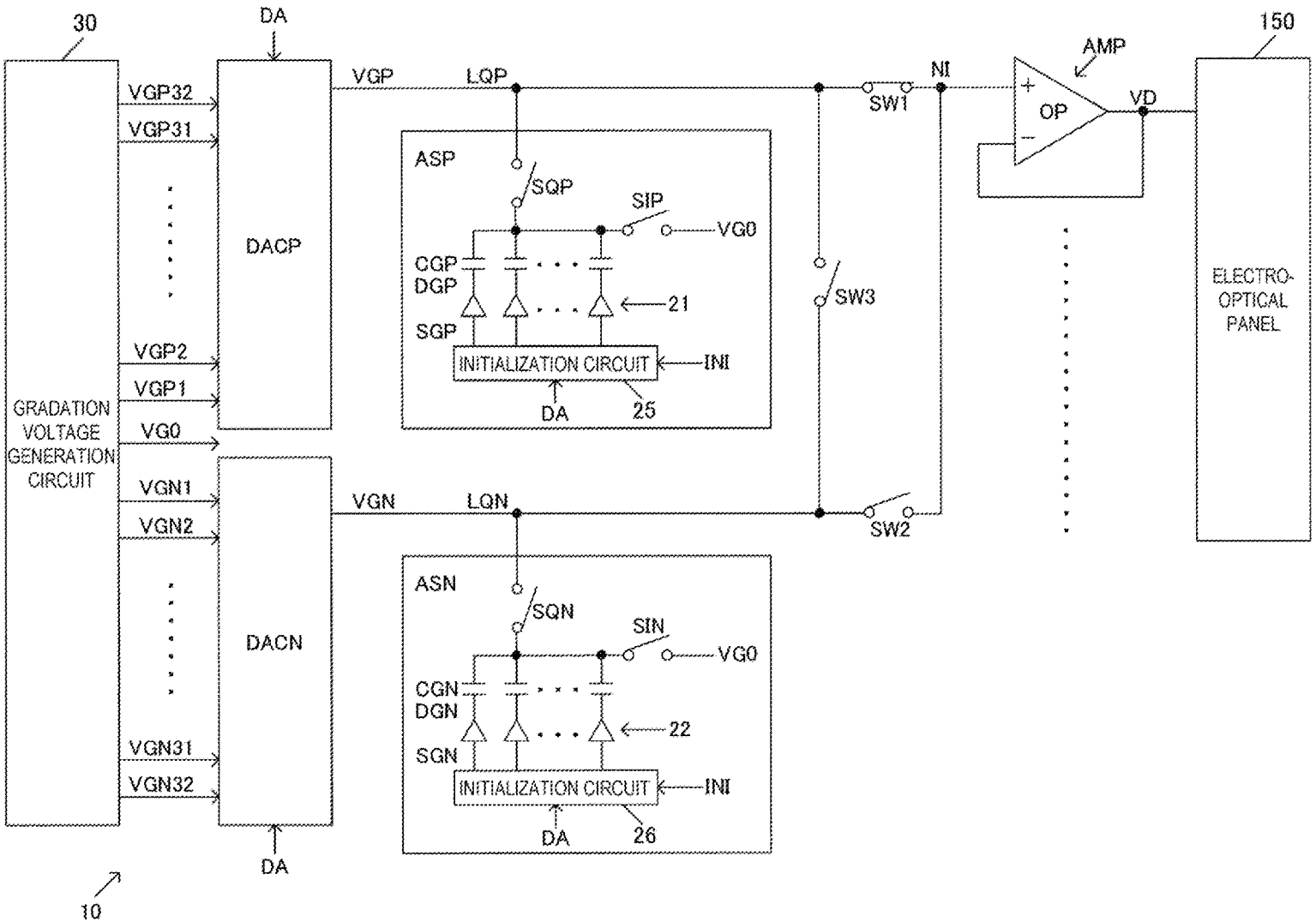
FIG. 11 illustrates a specific configuration example of the display driver.
Figure 12:
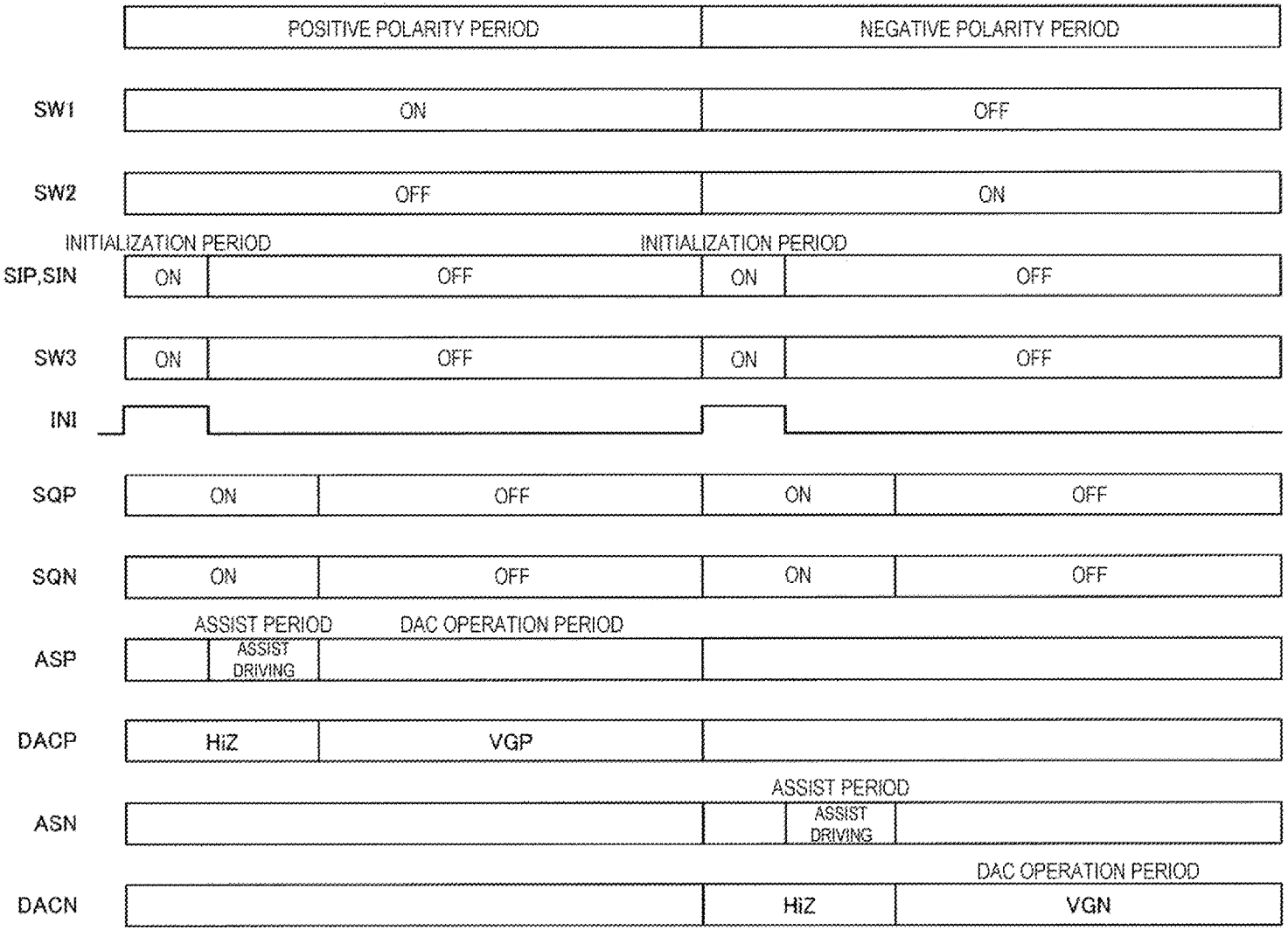
FIG. 12 is an explanatory diagram of an operation of the display driver.

FIG. 11 illustrates a specific configuration example of the display driver 10, and FIG. 12 illustrates an explanatory diagram of the operation of the display driver 10.

The display driver 10 of FIG. 11 includes the gradation voltage generation circuit 30. The gradation voltage generation circuit 30 generates the gradation voltages VGP1 to VGP32 for the positive polarity and supplies them to the D/A converter circuit DACP for the positive polarity. In addition, the gradation voltage generation circuit 30 generates the gradation voltages VGN1 to VGN32 for the negative polarity and supplies them to the D/A converter circuit DACN for the negative polarity. The gradation voltage generation circuit 30 generates the VG0 serving as the initialization voltage and supplies it to the assist circuits ASP and ASN. Note that in the detailed example of the display driver 10 described later, the VG0 is also supplied to the D/A converter circuits DACP and DACN. The gradation voltage generation circuit 30 can be achieved with, for example, a ladder resistance circuit including a plurality of resistors coupled in series, and outputs the gradation voltages VGP1 to VGP32, the initialization voltage VG0, and the gradation voltages VGN1 to VGN32 from a plurality of voltage division nodes of the ladder resistance circuit. The gradation voltages VGP1 to VGP32, the initialization voltage VG0, and the gradation voltages VGN1 to VGN32 have the voltage relationship of FIG. 7 described above.

In addition, in FIG. 11, the assist circuit ASP, which is the first assist circuit, includes an output switch SQP. The output switch SQP is a first output switch and can be achieved with a CMOS transistor or the like. The output switch SQP is provided between the other end of the capacitor group CGP, which is the first capacitor group, and the output line LQP, which is the first output line, and is turned on in the assist period of the assist circuit ASP as illustrated in FIG. 12. At this time, the output of the D/A converter circuit DACP is set to a high impedance state. In addition, the drive signal group DGP, which is the first drive signal group from the drive circuit 21, is input to one end of the capacitor group CGP. Then, after the output switch SQP is turned off, the D/A converter circuit DACP outputs the gradation voltage VGP to the output line LQP. Specifically, in the DAC operation period after the output switch SQP is switched from on to off, the D/A converter circuit DACP outputs, to the output line LQP, a voltage selected based on the display data DA from among the VGP1 to VGP32 as the gradation voltage VGP.

In FIG. 11, the assist circuit ASN, which is the second assist circuit, includes an output switch SQN. The output switch SQN is a second output switch and can be achieved with a CMOS transistor or the like. The output switch SQN is provided between the other end of the capacitor group CGN, which is the second capacitor group, and the output line LQN, which is the second output line, and the output switch SQN is turned on in the assist period of the assist circuit ASN as illustrated in FIG. 12. At this time, the output of the D/A converter circuit DACN is set to a high impedance state. In addition, a drive signal group DGN, which is a second drive signal group from the drive circuit 22, is input to one end of the capacitor group CGN. Then, after the output switch SQN is turned off, the D/A converter circuit DACN outputs the gradation voltage VGN to the output line LQN. Specifically, in the DAC operation period after the output switch SQN is switched from on to off, the D/A converter circuit DACN outputs, to the output line LQN, a voltage selected based on the display data DA from among the VGN1 to VGN32 as the gradation voltage VGN.

With the output switches SQP and SQN, in the assist period in the positive polarity period, the output switch SQP is turned on, and thus the assist driving of bringing the voltage of the output line LQP closer to the gradation voltage VGP output by the D/A converter circuit DACP through charge redistribution using the capacitor group CGP is achieved. Thus, high-speed positive polarity driving in the positive polarity period is achieved. In addition, in the assist period in the negative polarity period, the output switch SQN is turned on, and thus the assist driving of bringing the voltage of the output line LQN closer to the gradation voltage VGN output by the D/A converter circuit DACN through charge redistribution using the capacitor group CGN is achieved. Thus, high-speed negative polarity driving in the negative polarity period is achieved.

In addition, in the embodiment, the output switch SQP is turned on and the other end of the capacitor group CGP is set to the initialization voltage VG0 in the initialization period in the positive polarity period as illustrated in FIG. 12. As a result, the output line LQP is set to the initialization voltage VG0 through the output switch SQP that is turned on. At this time, for example, the output of the D/A converter circuit DACP is set to a high impedance state, and thus the output line LQP is set to the initialization voltage VG0.

Specifically, the assist circuit ASP includes an initialization switch SIP. One end of the initialization switch SIP is coupled to the other end of the capacitor group CGP, and the initialization voltage VG0 is input to the other end of the initialization switch SIP. The initialization switch SIP can be achieved with a CMOS transistor or the like. As illustrated in FIG. 12, when the initialization switch SIP is turned on in the initialization period, the other end of the capacitor group CGP is set to the initialization voltage VG0. More specifically, in the initialization period, when the output switch SQP and the initialization switch SIP are turned on, the output line LQP is set to the initialization voltage VG0. As illustrated in FIG. 12, after the initialization period, the initialization switch SIP is turned off, and after the assist circuit ASP has performed assist driving of the output line LQP, the output switch SQP is turned off. Then, after the output switch SQP is turned off, the D/A converter circuit DACP outputs the gradation voltage VGP to the output line LQP.

In addition, in the initialization period in the negative polarity period, the output switch SQN is turned on, and the other end of the capacitor group CGN is set to the initialization voltage VG0 as illustrated in FIG. 12 in the embodiment. As a result, the output line LQN is set to the initialization voltage VG0 through the output switch SQN that is turned on. At this time, for example, the output of the D/A converter circuit DACN is set to a high impedance state, and thus the output line LQN is set to the initialization voltage VG0.

Specifically, the assist circuit ASN includes an initialization switch SIN. One end of the initialization switch SIN is coupled to the other end of the capacitor group CGN, and the initialization voltage VG0 is input to the other end of the initialization switch SIN. The initialization switch SIN can be achieved with a CMOS transistor or the like. Then, as illustrated in FIG. 12, when the initialization switch SIN is turned on in the initialization period, the other end of the capacitor group CGN is set to the initialization voltage VG0. More specifically, in the initialization period, the output switch SQN and the initialization switch SIN are turned on and thus the output line LQN is set to the initialization voltage VG0. Then, as illustrated in FIG. 12, after the initialization period, the initialization switch SIN is turned off, and, after the assist circuit ASN performs assist driving of the output line LQN, the output switch SQN is turned off. Then, after the output switch SQN is turned off, the D/A converter circuit DACN outputs the gradation voltage VGN to the output line LQN.

As described above, in the embodiment, in the initialization period in the positive polarity period, the output switch SQP is turned on and the other end of the capacitor group CGP is set to the initialization voltage VG0, and thus, the output line LQP is set to the initialization voltage VG0. As a result, after the output line LQP is set to the initialization voltage VG0 in the initialization period in the positive polarity period, the assist circuit ASP can perform assist driving in the assist period. Specifically, in the initialization period, the output line LQP is set to the initialization voltage VG0, and, from the state where the output line LQP is set to the initialization voltage VG0 in the above-mentioned manner, the assist circuit ASP performs the assist driving of bringing the voltage of the output line LQP closer to the gradation voltage VGP output by the D/A converter circuit DACP. In this manner, even in the case where the assist driving is repeatedly performed, the assist circuit ASP can perform the assist driving with the initialization voltage VG0 as the starting voltage. For example, the gate capacitance as the parasitic capacitance of the output line LQP has voltage-dependence, and the gate capacitance as the parasitic capacitance fluctuates in accordance with the voltage of the output line LQP. As such, when the assist driving is performed with a different voltage as the starting voltage, there is a possibility that the assist voltage of the assist circuit ASP is shifted. In this regard, in the embodiment, the assist driving is performed with the initialization voltage VG0 as the starting voltage. Thus, even in the case where the assist driving of the assist circuit ASP is repeatedly performed many times, a situation in which the assist voltage of the assist circuit ASP is gradually shifted can be prevented. In addition, it suffices that the assist circuit ASP for the positive polarity performs the assist driving of increasing the voltage of the output line LQP from the initialization voltage VG0 to the voltage on the high potential side, and thus the assist driving is simplified.

In addition, in the embodiment, in the initialization period in the negative polarity period, the output switch SQN is turned on and the other end of the capacitor group CGN is set to the initialization voltage VG0, and thus, the output line LQN is set to the initialization voltage VG0. As a result, after the output line LQN is set to the initialization voltage VG0 in the initialization period in the negative polarity period, the assist circuit ASN can perform the assist driving in the assist period. Specifically, in the initialization period, the output line LQN is set to the initialization voltage VG0, and, from the state where the output line LQN is set to the initialization voltage VG0 in the above-mentioned manner, the assist circuit ASN performs the assist driving of bringing the voltage of the output line LQN closer to the gradation voltage VGN output by the D/A converter circuit DACN. In this manner, it is possible to prevent a situation in which the assist voltage of the assist circuit ASN is gradually shifted in the case where the assist driving of the assist circuit ASN is repeatedly performed many times. In addition, it suffices that the assist circuit ASN for the negative polarity performs the assist driving of reducing the voltage of the output line LQN from the initialization voltage VG0 to the voltage on the low potential side, and thus the assist driving is simplified.

The initialization voltage VG0 is an intermediate voltage between the high potential voltage in the positive polarity driving in the positive polarity period and the low potential voltage in the negative polarity driving in the negative polarity period. Specifically, as illustrated in FIGS. 7 and 10, the initialization voltage VG0 is an intermediate voltage of VGP32, which is a high potential voltage in the positive polarity driving, and VGN32, which is a low potential voltage in the negative polarity driving. As an example, a relationship of VG0=(VGP32+VGN32)/2 holds. For example, in the case of VGP32=12.5V and VGN32=2.5V, VG0=7.5V holds.

In this manner, the assist circuit ASP can perform the assist driving in the voltage range of VG0 to VGP32 in the positive polarity period, and the assist circuit ASN can perform the assist driving in the voltage range of VG0 to VGN32 in the negative polarity period. For example, the assist circuit ASP performs the assist driving of changing the voltage of the output line LQP from the initialization voltage VG0 to the voltage on the high potential side on the basis of the display data DA. The assist circuit ASN performs the assist driving of changing the voltage of the output line LQN from the initialization voltage VG0 to the voltage on the low potential side on the basis of the display data DA. Thus, the assist driving can be achieved with a simple control, and the circuit configuration and the circuit control can be simplified.

The display driver 10 includes a switch SW3 provided between the output line LQP, which is the first output line, and the output line LQN, which is the second output line. The switch SW3 is a third switch, and can be achieved with, for example, a CMOS transistor or the like. For example, one end of the switch SW3 is coupled to one end of the switch SW1 and the output line LQP. The other end of the switch SW3 is coupled to one end of the switch SW2 and the output line LQN. The other ends of the switches SW1 and SW2 are coupled to the input node NI of the amplifier circuit AMP. In addition, as illustrated in FIG. 12, the switch SW3 is turned on in the initialization period in the positive polarity period. In addition, the switch SW3 is turned on in the initialization period in the negative polarity period.

With the switch SW3, the output line LQP and the output line LQN can be shorted in the initialization period. By shorting the output lines LQP and LQN in this manner, the output lines LQP and LQN can be set to the initialization voltage VG0 early in the initialization period, and the assist circuits ASP and ASN can perform the assist driving with the initialization voltage VG0 as the starting voltage. Thus, since it suffices that the assist circuit ASP performs the assist driving of changing the voltage of the output line LQP from the initialization voltage VG0 to the voltage on the high potential side, and that the assist circuit ASN performs the assist driving of changing the voltage of the output line LQN from the initialization voltage VG0 to the voltage on the low potential side, the assist driving can be achieved with a simple control.

In addition, the drive circuit 21 sets the drive signal group DGP to a low level voltage in the initialization period in the positive polarity period. For example, the voltage level of the GND is set. On the other hand, the drive circuit 22 sets the drive signal group DGN to a high level voltage in the initialization period in the negative polarity period. For example, the voltage level of the VDDH is set. Here, the drive circuit 21 is the first drive circuit, and the drive signal group DGP is the first drive signal group. In addition, the drive circuit 22 is the second drive circuit, and the drive signal group DGN is the second drive signal group.

Specifically, the other end of the capacitor group CGP is set to the initialization voltage VG0 in the initialization period in the positive polarity period, and the drive circuit 21 outputs the drive signal group DGP set to the low level voltage to one end of the capacitor group CGP. As a result, in the initialization period, the charge corresponding to the voltage difference between the initialization voltage VG0 and the low level voltage is accumulated in the capacitor group CGP. Thus, in the assist period after the initialization period, the drive circuit 21 outputs the drive signal group DGP corresponding to the display data DA to one end of the capacitor group CGP so as to achieve the assist driving of changing the voltage of the output line LQP from the initialization voltage VG0 to the voltage on the high potential side.

In addition, in the initialization period in the negative polarity period, the other end of the capacitor group CGN is set to the initialization voltage VG0, and the drive circuit 22 outputs the drive signal group DGN set to the high level voltage to one end of the capacitor group CGN. As a result, in the initialization period, the charge corresponding to the voltage difference between the initialization voltage VG0 and the high level voltage is accumulated in the capacitor group CGN. Then, in the assist period after the initialization period, the drive circuit 22 outputs the drive signal group DGN corresponding to the display data DA to one end of the capacitor group CGN so as to achieve the assist driving of changing the voltage of the output line LQN from the initialization voltage VG0 to the voltage on the low potential side.

In addition, the assist circuit ASP includes an initialization circuit 25. The initialization circuit 25 outputs the control signal group SGP for initialization to the drive circuit 21 in the initialization period in the positive polarity period, and outputs the control signal group SGP corresponding to the display data DA to the drive circuit 21 in the assist period in the positive polarity period. The initialization circuit 25 is the first initialization circuit, and the control signal group SGP is the first control signal group. For example, in the initialization period in the positive polarity period, when the initialization signal INI is activated as illustrated in FIG. 12, the initialization circuit 25 outputs the control signal group SGP for initialization to the drive circuit 21. For example, the initialization circuit 25 outputs the control signal group SGP that initializes the drive signal group DGP output by the drive circuit 21 to the low level voltage. Then, the initialization circuit 25 outputs the control signal group SGP corresponding to the display data DA to the drive circuit 21 in the assist period after the initialization period. In this manner, the drive circuit 21 outputs the drive signal group DGP corresponding to the display data DA to one end of the capacitor group CGP. Thus, the assist driving of increasing the voltage of the output lines LQP from the initialization voltage VG0 to a voltage corresponding to the display data DA is achieved.

In addition, the assist circuit ASN includes an initialization circuit 26. The initialization circuit 26 outputs the control signal group SGN for initialization to the drive circuit 22 in the initialization period in the negative polarity period, and outputs the control signal group SGN corresponding to the display data DA to the drive circuit 22 in the assist period in the negative polarity period. The initialization circuit 26 is the second initialization circuit, and the control signal group SGN is the second control signal group. For example, in the initialization period in the negative polarity period, when the initialization signal INI is activated as illustrated in FIG. 12, and the initialization circuit 26 outputs the control signal group SGN for initialization to the drive circuit 22. For example, the initialization circuit 26 outputs the control signal group SGN that initializes the drive signal group DGN output by the drive circuit 22 to a high level voltage. Then, the initialization circuit 26 outputs the control signal group SGN corresponding to the display data DA to the drive circuit 22 in the assist period after the initialization period. In this manner, the drive circuit 22 outputs the drive signal group DGN corresponding to the display data DA to one end of the capacitor group CGN. Thus, the assist driving of reducing the voltage of the output line LQN from the initialization voltage VG0 to a voltage corresponding to the display data DA is achieved.

3. Detailed Configuration Example

Figure 13:
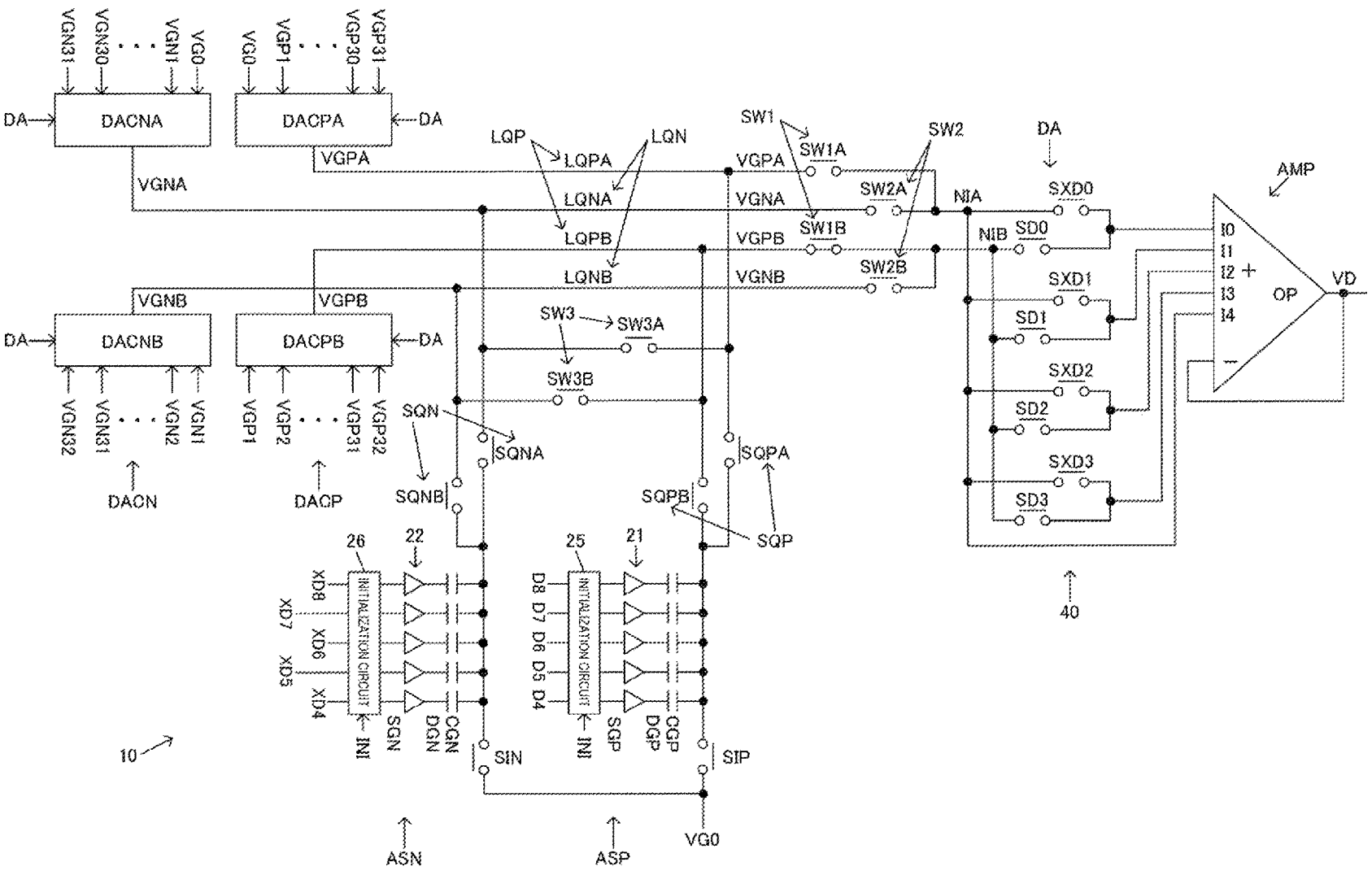
FIG. 13 illustrates a detailed first configuration example of the display driver.

FIG. 13 illustrates a detailed first configuration example of the display driver 10 of the embodiment. In FIG. 13, a first gradation output line LQPA and a second gradation output line LQPB are provided as output lines LQP. Specifically, a first gradation output line LQPA for the positive polarity and a second gradation output line LQPB for the positive polarity are provided as output lines LQP for the positive polarity. In addition, a first gradation output line LQNA and a second gradation output line LQNB are provided as output lines LQN. Specifically, a first gradation output line LQNA for the negative polarity and a second gradation output line LQNB for the negative polarity are provided as output lines LQN for the negative polarity.

The D/A converter circuit DACP outputs a first gradation voltage VGPA to the first gradation output line LQPA on the basis of the upper bit data of the display data DA, and outputs a second gradation voltage VGPB to the second gradation output line LQPB on the basis of the upper bit data. The first gradation voltage VGPA and the second gradation voltage VGPB have the voltage relationship illustrated in FIG. 7. For example, the voltage difference between the first gradation voltage VGPA and the second gradation voltage VGPB is a voltage difference corresponding to the lowest bit of the upper bit of the display data DA.

In addition, the D/A converter circuit DACN outputs a first gradation voltage VGNA to the first gradation output line LQNA on the basis of the upper bit data of the display data DA, and outputs a second gradation voltage VGNB to the second gradation output line LQNB on the basis of the upper bit data. The first gradation voltage VGNA and the second gradation voltage VGNB have the voltage relationship illustrated in FIG. 7. For example, the voltage difference between the first gradation voltage VGNA and the second gradation voltage VGNB is a voltage difference corresponding to the lowest bit of the upper bit of the display data DA.

The amplifier circuit AMP outputs the drive voltage VD corresponding to the gradation voltage between the first gradation voltage VGPA and the second gradation voltage VGPB on the basis of the lower bit data of the display data DA. Specifically, in the positive polarity period, the amplifier circuit AMP outputs, as the drive voltage VD, the gradation voltage corresponding to the lower bit data of the display data DA between the second gradation voltage VGPB and the first gradation voltage VGPA for the positive polarity.

In addition, the amplifier circuit AMP outputs the drive voltage VD corresponding to the gradation voltage between the first gradation voltage VGNA and the second gradation voltage VGNB on the basis of the lower bit data of the display data DA. Specifically, in the negative polarity period, the amplifier circuit AMP outputs, as the drive voltage VD, the gradation voltage corresponding to the lower bit data of the display data DA between the second gradation voltage VGNB and the first gradation voltage VGNA for the negative polarity.

With such a configuration, it suffices that the D/A converter circuits DACP and DACN perform D/A conversion based on the upper bit data of the display data DA, and the resolution of the D/A conversion required for the D/A converter circuits DACP and DACN can be reduced. The D/A conversion based on the lower bit data of the display data DA can be performed by the amplifier circuit AMP. Thus, the number and the like of the switching elements that constitute the D/A converter circuits DACP and DACN can be reduced, and thus the sizes of D/A converter circuits DACP and DACN can be reduced.

In addition, in FIG. 13, the assist circuit ASP is coupled to the first gradation output line LQPA and the second gradation output line LQPB. Specifically, the assist circuit ASP for the positive polarity is coupled to the first gradation output line LQPA for the positive polarity and the second gradation output line LQPB for the positive polarity. In addition, the assist circuit ASN is coupled to the first gradation output line LQNA and the second gradation output line LQNB. Specifically, the assist circuit ASN for the negative polarity is coupled to the first gradation output line LQNA for the negative polarity and the second gradation output line LQNB for the negative polarity.

In this manner, the assist driving of the first gradation output line LQPA and the second gradation output line LQPB can be performed by one assist circuit ASP. Specifically, in the positive polarity period, the assist driving of both the first gradation output line LQPA and the second gradation output line LQPB for the positive polarity is performed by the assist circuit ASP for the positive polarity. Thus, since the assist driving can be performed by the one assist circuit ASP even in the case where the first gradation output line LQPA and the second gradation output line LQPB are provided as the output lines LQP, the size of the circuit can be reduced. In addition, the assist driving of the first gradation output line LQNA and the second gradation output line LQNB can be performed by one assist circuit ASN. Specifically, in the negative polarity period, the assist driving of both the first gradation output line LQNA and the second gradation output line LQNB for the negative polarity is performed by the assist circuit ASN for the negative polarity. Thus, since the assist driving can be performed by the one assist circuit ASN even in the case where the first gradation output line LQNA and the second gradation output line LQNB are provided as the output line LQN, the size of the circuit can be reduced.

Now the configuration of FIG. 13 is described in more detail. The D/A converter circuit DACP for the positive polarity includes D/A converters DACPA and DACPB. VG0 to VGP31 are input to the D/A converter DACPA, and the D/A converter DACPA outputs, as the first gradation voltage VGPA, a voltage selected based on the upper bit data of the display data DA from among the VG0 to VGP31. VGP1 to VGP32 are input to the D/A converter DACPB, and the D/A converter DACPB outputs, as the second gradation voltage VGPB, a voltage selected based on the upper bit data of the display data DA from among the VGP1 to VGP32. For example, in the case where the D/A converter DACPA selects and outputs VGPA=VGP31, the D/A converter DACPB selects and outputs VGPB=VGP32. In the case where the D/A converter DACPA selects and outputs VGPA=VGP30, the D/A converter DACPB selects and outputs VGPB=VGP31. Specifically, the D/A converters DACPA and DACPB output the first gradation voltage VGPA and the second gradation voltage VGPB that are adjacent to each other. Here, the voltage difference of the adjacent first gradation voltage VGPA and second gradation voltage VGPB is a voltage difference corresponding to the lowest bit of the upper bit of the display data DA.

The D/A converter circuit DACN for the negative polarity includes D/A converters DACNA and DACNB. VG0 to VGN31 are input to the D/A converter DACNA, and the D/A converter DACNA outputs, as the first gradation voltage VGNA, a voltage selected based on the upper bit data of the display data DA from among the VG0 to VGN31. VGN1 to VGN32 are input to the D/A converter DACNB, and the D/A converter DACNB outputs, as the second gradation voltage VGNB, a voltage selected based on the upper bit data of the display data DA from among the VGN1 to VGN32. For example, in the case where the D/A converter DACNA selects and outputs VGNA=VGN31, the D/A converter DACNB selects and outputs VGNB=VGN32. In the case where the D/A converter DACNA selects and outputs VGNA=VGN30, the D/A converter DACNB selects and outputs VGNB=VGN31. Specifically, the D/A converters DACNA and DACNB output the first gradation voltage VGNA and the second gradation voltage VGNB that are adjacent to each other. Here, the voltage difference of the adjacent first gradation voltage VGNA and second gradation voltage VGNB is a voltage difference corresponding to the lowest bit of the upper bit of the display data DA.

In addition, in FIG. 13, switches SW1A and SW1B are provided as switches SW1, which are first switches. The first gradation voltage VGPA and the second gradation voltage VGPB are input to the switches SW1A and SW1B, respectively, and the switches SW1A and SW1B are turned on in the positive polarity period. In addition, switches SW2A and SW2B are provided as switches SW2, which are second switches. The first gradation voltage VGNA and the second gradation voltage VGNB are input to the switches SW2A and SW2B, respectively, and the switches SW2A and SW2B are turned on in the negative polarity period.

In addition, in FIG. 13, switches SW3A and SW3B are provided as switches SW3, which are third switches. The switch SW3A is provided between the first gradation output line LQPA for the positive polarity and the first gradation output line LQNA for the negative polarity. The switch SW3B is provided between the second gradation output line LQPB for the positive polarity and the second gradation output line LQNB for the negative polarity. The switches SW3A and SW3B are turned on in the initialization period in the positive polarity period and the initialization period in the negative polarity period.

In FIG. 13, output switches SQPA and SQPB are provided as output switches SQP, which are first output switches, and output switches SQNA and SQNB are provided as output switches SQN, which are second output switches. The output switch SQPA is provided between the first gradation output line LQPA for the positive polarity and the other end of the capacitor group CGP. The output switch SQPB is provided between the second gradation output line LQPB for the positive polarity and the other end of the capacitor group CGP. The output switches SQPA and SQPB are turned on in the assist period in the positive polarity period. The output switch SQNA is provided between the first gradation output line LQNA for the negative polarity and the other end of the capacitor group CGN. The output switch SQNB is provided between the second gradation output line LQNB for the negative polarity and the other end of the capacitor group CGN. The output switches SQNA and SQNB are turned on in the assist period in the negative polarity period.

In the initialization circuit 25, D4 to D8 are input as the upper bit data of the display data DA. Then, as described above, the initialization circuit 25 outputs the control signal group SGP that initializes the drive signal group DGP output from the drive circuit 21 to the low level voltage in the initialization period in the positive polarity period. Then, in the assist period after the initialization period, the initialization circuit 25 outputs the control signal group SGP corresponding to the D4 to D8, which are the upper bit data of the display data DA. For example, when the bit data of any of the D4 to D8 becomes "1", the control signal corresponding to that bit data in the control signal group SGP is set to the high level, and the drive signal corresponding to that control signal in the drive signal group SGP changes from the low level voltage to the high level voltage. Thus, the assist driving of increasing the voltage of the first gradation output line LQPA and the second gradation output line LQPB from the initialization voltage VG0 to a voltage corresponding to the display data DA can be achieved.

In addition, as the upper bit data of the display data DA, XD4 to XD8 are input to the initialization circuit 26. Here, "X" means negative logic. As described above, in the initialization period in the negative polarity period, the initialization circuit 26 outputs the control signal group SGN that initializes the drive signal group DGN output from the drive circuit 22 to the high level voltage. In the assist period after the initialization period, the initialization circuit 26 outputs the control signal group SGN corresponding to the XD4 to XD8, which are the upper bit data of the display data DA. For example, when the bit data of any of the XD4 to XD8 becomes "0", the control signal corresponding to that bit data in the control signal group SGN is set to the low level, and the drive signal corresponding to that control signal in the drive signal group DGN changes from the high level voltage to the low level voltage. Thus, the assist driving of reducing the voltage of the first gradation output line LQNA and the second gradation output line LQNB from the initialization voltage VG0 to a voltage corresponding to the display data DA can be achieved.

In FIG. 13, the amplifier circuit AMP includes a switch circuit 40 composed of switches SD0 to SD3 and SXD0 to SXD3. The switches SD0, SD1, SD2 and SD3 are turned on when D0, D1, D2 and D3, which are the lower bit data of the display data DA, are "1". The switches SXD0, SXD1, SXD2 and SXD3 are turned on when D0, D1, D2 and D3 are "0".

In addition, the operational amplifier OP provided in the amplifier circuit AMP includes input terminals I0, I1, I2, I3, and I4 as the non-inverting input terminal (+). The inverting input terminal (−) of the operational amplifier OP is coupled to the output terminal of the operational amplifier OP. For example, the operational amplifier OP is weighted for the differential transistors corresponding to the input terminals I0, I1, I2, I3 and I4, and outputs the drive voltages VD of weighted voltage levels for the voltages input to the input terminals I0, I1, I2, I3 and I4.

The switches SXD0, SXD1, SXD2 and SXD3 of the switch circuit 40 are provided between a first input node NIA of the amplifier circuit AMP and the input terminals I0, I1, I2 and I3 of the operational amplifier OP, respectively. The switches SD0, SD1, SD2 and SD3 of the switch circuit 40 are provided between a second input node NIB of the amplifier circuit AMP and the input terminals I0, I1, I2 and I3 of the operational amplifier OP, respectively. In addition, the first input node NIA is coupled to the input terminal I4 of the operational amplifier OP.

When the switches SW1A and SW1B are turned on and the switches SW2A and SW2B are turned off in the positive polarity period, the first gradation voltage VGPA is input to the first input node NIA of the amplifier circuit AMP, and the second gradation voltage VGPB is input to the second input node NIB of the amplifier circuit AMP. Then, when the switches SD0 to SD3 and SXD0 to SXD3 are turned on or off in accordance with the lower bit data D0, D1, D2, and D3 of the display data DA, the amplifier circuit AMP outputs the drive voltage VD corresponding to the gradation voltage between the first gradation voltage VGPA and the second gradation voltage VGPB. Note that the amplifier circuit AMP outputs the drive voltage VD corresponding to the first gradation voltage VGPA in the case of D0=D1=D2=D3=0, whereas the amplifier circuit AMP outputs the drive voltage VD corresponding to the second gradation voltage VGPB in the case of D0=D1=D2=D3=1.

On the other hand, when the switches SW2A and SW2B are turned on and the switches SW1A and SW1B are turned off in the negative polarity period, the first gradation voltage VGNA is input to the first input node NIA of the amplifier circuit AMP, and the second gradation voltage VGNB is input to the second input node NIB. Then, when the switches SD0 to SD3 and SXD0 to SXD3 are turned on or off in accordance with the lower bit data D0, D1, D2, and D3 of the display data DA, the amplifier circuit AMP outputs the drive voltage VD corresponding to the gradation voltage between the first gradation voltage VGNA and the second gradation voltage VGNB. Note that the amplifier circuit AMP outputs the drive voltage VD corresponding to the first gradation voltage VGNA in the case of D0=D1=D2=D3=0, whereas the amplifier circuit AMP outputs the drive voltage VD corresponding to the second gradation voltage VGNB in the case of D0=D1=D2=D3=1.

A specific example of the circuit configuration of the operational amplifier OP is described in, for example, FIGS. 9 to 12 of JP-A-2019-90957. For example, the operational amplifier OP includes differential transistors TD0, TD1, TD2, TD3 and TD4 (not illustrated) for non-inverting input, to which the input terminals I0, I1, I2, I3 and I4 are coupled to the gate. Each of the differential transistors TD0, TD1, TD2, TD3, and TD4 is composed of unit transistors, and a binary weighting such as 1:2:4:8:16 is assigned in accordance with the number of unit transistors that constitute each differential transistor. For example, in the positive polarity period, when the lower bit data of the display data DA is D0=D1=D2=D3=0, the first gradation voltage VGPA lower than the second gradation voltage VGPB is input to the gates of the differential transistors TD0 to TD4. As a result, the amplifier circuit AMP outputs the drive voltage VD corresponding to the first gradation voltage VGPA. In addition, in the positive polarity period, when the lower bit data of the display data DA is D0=D1=D2=D3=1, the second gradation voltage VGPB higher than the first gradation voltage VGPA is input to the gates of the differential transistors TD0 to TD4. As a result, the amplifier circuit AMP outputs the drive voltage VD corresponding to the second gradation voltage VGPB. Assume that Di is "0" and Dj is "1" in the lower bit data D0, D1, D2, and D3 of the display data DA in the positive polarity period. Here, $0 \leq i \leq 3$ and $0 \leq j \leq 3$ hold, and i and j are different integers. In this case, in the TD0 to TD4, the first gradation voltage VGPA is input to the differential transistor corresponding to Di, and the second gradation voltage VGPB is input to the differential transistor corresponding to Dj. As a result, the amplifier circuit AMP outputs the drive voltage VD corresponding to the gradation voltage between the first gradation voltage VGPA and the second gradation voltage VGPB. The amplifier circuit AMP performs a similar operation in the negative polarity period.

Figure 14:
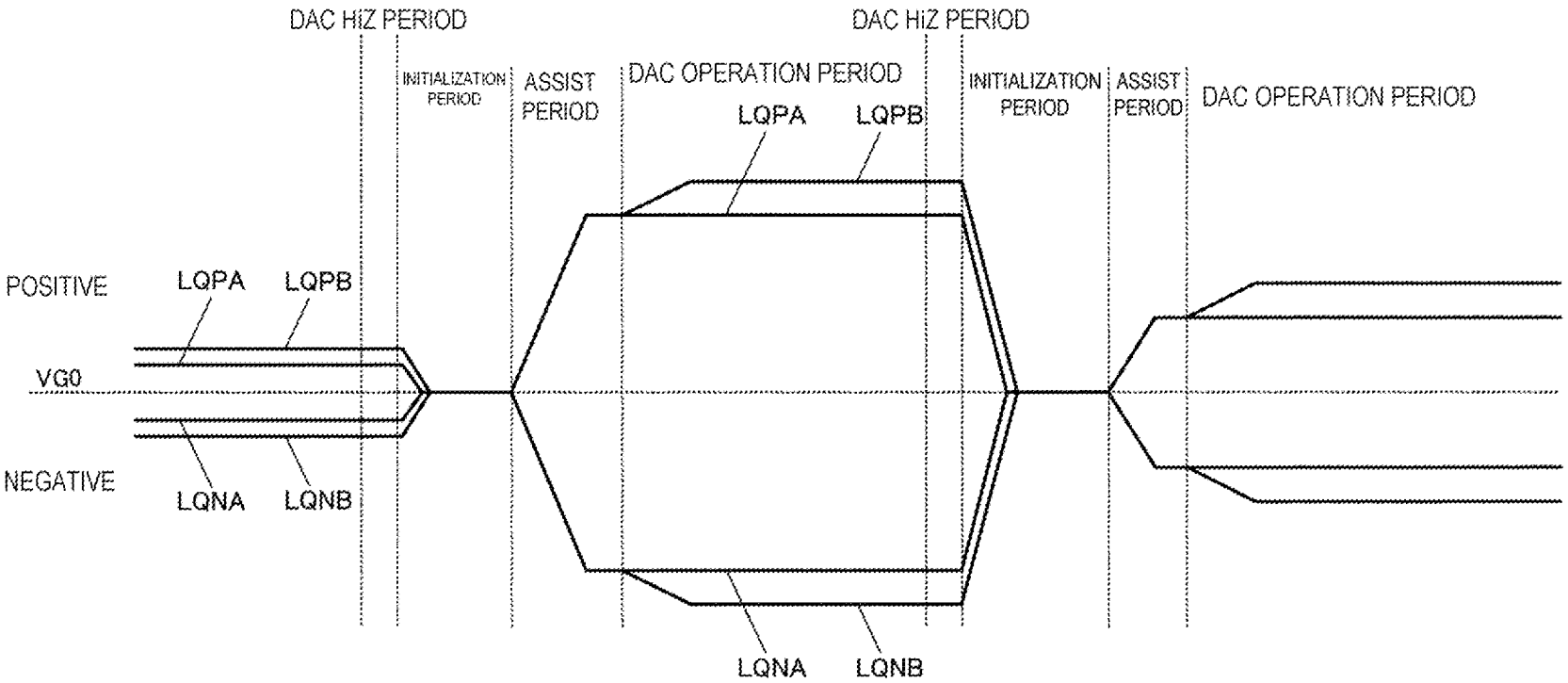
FIG. 14 is a signal waveform diagram for describing an operation of the display driver of the first configuration example.

FIG. 14 is a signal waveform diagram for describing an operation of the display driver 10 of the first configuration example of FIG. 13. While a signal waveform in the positive polarity period is illustrated in the upper part and a signal waveform in the negative polarity period is illustrated in the lower part for the sake of convenience of the description in FIG. 14, note that the positive polarity period and the negative polarity period are different periods as illustrated in FIG. 12. First, the outputs of the D/A converter circuits DACP and DACN are set to a high impedance state. Then, in the initialization period, the first gradation output line LQPA and the second gradation output line LQPB for the positive polarity and the first gradation output line LQNA and the second gradation output line LQNB for the negative polarity are set to the initialization voltage VG0. Specifically, when the output switches SQPA, SQPB, SQNA, and SQNB, the initialization switches SIP and SIN, and the switches SW3A and SW3B are turned on, and the gradation output lines thereof are set to the initialization voltage VG0. Thereafter, the assist driving is performed by the assist circuit ASP or the assist circuit ASN. For example, in the positive polarity period, the assist driving of increasing the voltage of the first gradation output line LQPA and the second gradation output line LQPB from the initialization voltage VG0 to the voltage on the high potential side is performed. In addition, in the negative polarity period, the assist driving of reducing the voltage of the first gradation output line LQNA and the second gradation output line LQNB from the initialization voltage VG0 to the voltage on the low potential side is performed. Then, after the assist period, the D/A converter circuit DACP or the D/A converter circuit DACN is operated to perform the DAC driving. For example, in the positive polarity period, the DAC driving of setting the voltage of the first gradation output line LQPA to the first gradation voltage VGPA, and setting the voltage of the second gradation output line LQPB to the second gradation voltage VGPB is performed. In addition, in the negative polarity period, the DAC driving of setting the voltage of the first gradation output line LQNA to the first gradation voltage VGNA, and setting the voltage of the second gradation output line LQNB to the second gradation voltage VGNB is performed. In this manner, the positive polarity driving in the positive polarity period and the negative polarity driving in the negative polarity period can be achieved while performing the assist driving.

Figure 15:
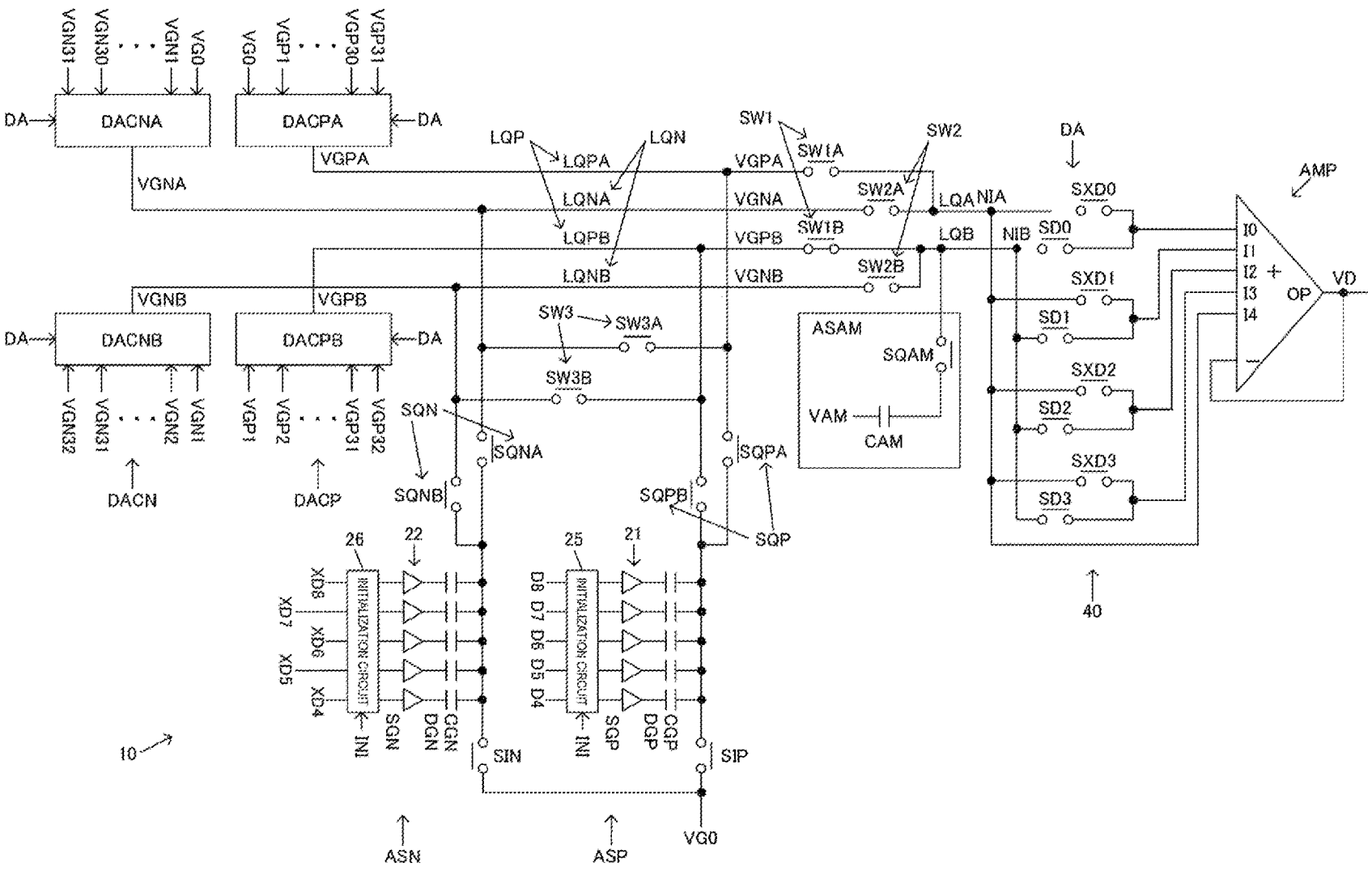
FIG. 15 illustrates a detailed second configuration example of the display driver.

FIG. 15 illustrates a detailed second configuration example of the display driver 10. In FIG. 15, an assist circuit ASAM for the amplifier circuit is added to the first configuration example of FIG. 13. For the sake of convenience of the description, the first gradation output lines LQPA and LQNA are collectively referred to as a first gradation output line LQA, and the second gradation output lines LQPB and LQNB are collectively referred to as a second gradation output line LQB as illustrated in FIG. 15. For example, in the positive polarity period, when the switches SW1A and SW1B are turned on, the first gradation output line LQA serves as the first gradation output line LQPA, and the second gradation output line LQB serves as the second gradation output line LQPB. In the negative polarity period, when the switches SW2A and SW2B are turned on, the first gradation output line LQA serves as the first gradation output line LQNA, and the second gradation output line LQB serves as the second gradation output line LQNB.

In this case, the assist circuit ASAM for the amplifier circuit is coupled to one of the first gradation output line LQA and the second gradation output line LQB. In FIG. 15, the assist circuit ASAM is coupled to the second gradation output line LQB. For example, the assist circuit ASAM for the amplifier circuit includes an output switch SQAM and a capacitor CAM. A drive signal VAM is input to one end of the capacitor CAM. One end of the output switch SQAM is coupled to the second gradation output line LQB, and the other end of the output switch SQAM is coupled to the other end of the capacitor CAM. Note that the assist circuit ASAM may be coupled to the first gradation output line LQA. As described above, the first gradation output line LQA is one of the first gradation output line LQPA for the positive polarity and the first gradation output line LQNA for the negative polarity, and is coupled to the first input node NIA of the amplifier circuit AMP. In addition, the second gradation output line LQB is one of the second gradation output line LQPB for the positive polarity and the second gradation output line LQNB for the negative polarity, and is coupled to the second input node NIB of the amplifier circuit AMP.

After the assist circuit ASP or the assist circuit ASN performs the assist driving of the first gradation output line LQA and the second gradation output line LQB, the assist circuit ASAM for the amplifier circuit performs the assist driving of the second gradation output line LQB, which is one gradation output line.

For example, in the positive polarity period, the assist circuit ASP performs the assist driving of increasing the voltage of the first gradation output line LQPA, which serves as the first gradation output line LQA, and the voltage of the second gradation output line LQPB, which serves as the second gradation output line LQB. After the assist driving is performed by the assist circuit ASP, the assist circuit ASAM for the amplifier circuit performs the assist driving of the second gradation output line LQPB (LQB), which is one gradation output line to which the assist circuit ASAM is coupled. For example, in the positive polarity period, the assist circuit ASAM performs the assist driving of increasing the voltage of the second gradation output line LQPB (LQB). Thus, a small voltage difference between the first gradation voltage VGPA and the second gradation voltage VGPB can be generated at high speed.

On the other hand, in the negative polarity period, the assist circuit ASN performs the assist driving of reducing the voltage of the first gradation output line LQNA, which serves as the first gradation output line LQA, and the voltage of the second gradation output line LQNB, which serves as the second gradation output line LQB. After the assist driving is performed by the assist circuit ASN, the assist circuit ASAM for the amplifier circuit performs the assist driving of the second gradation output line LQNB (LQB), which is one gradation output line to which the assist circuit ASAM is coupled. For example, in the negative polarity period, the assist circuit ASAM performs the assist driving of reducing the voltage of the second gradation output line LQNB (LQB). Thus, a small voltage difference between the first gradation voltage VGNA and the second gradation voltage VGNB can be generated at high speed.

Figure 16:
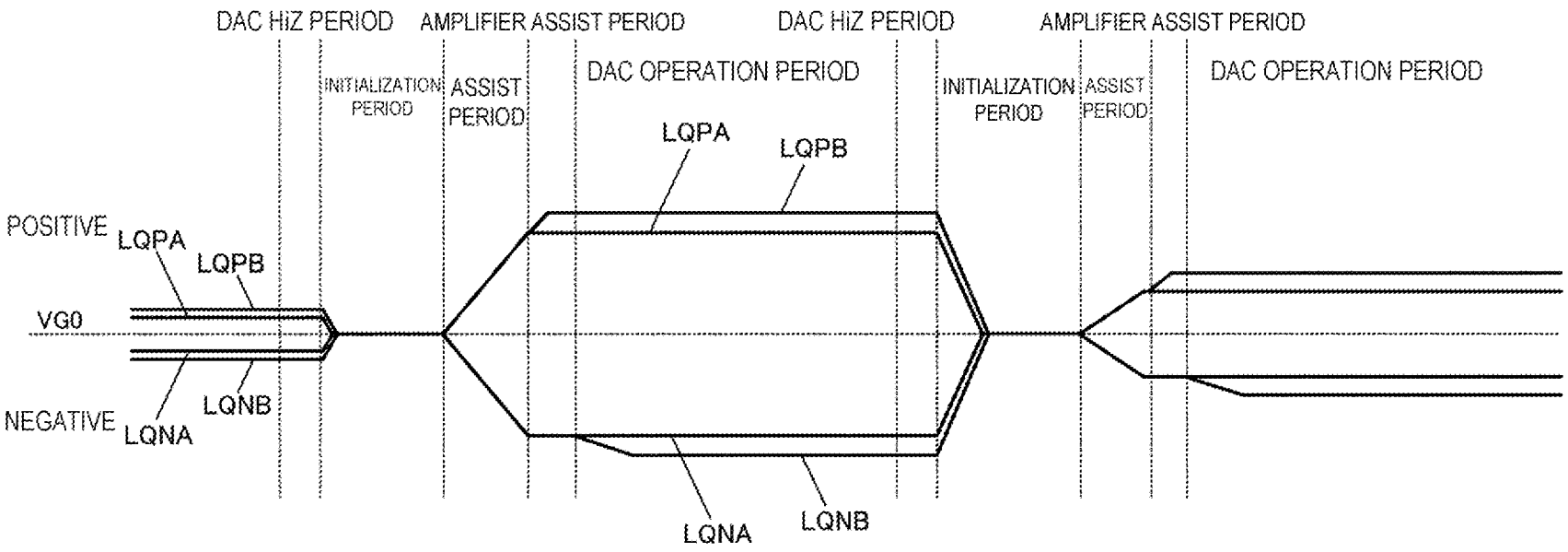
FIG. 16 is a signal waveform diagram for describing an operation of the display driver of the second configuration example.

FIG. 16 is a signal waveform diagram for describing an operation of the display driver 10 of the second configuration example illustrated in FIG. 15. While a signal waveform in the positive polarity period is illustrated in the upper part, and a signal waveform in the negative polarity period is illustrated in the lower part for the sake of convenience of the description in FIG. 16, note that the positive polarity period and the negative polarity period are different periods. First, the outputs of the D/A converter circuits DACP and DACN are set to a high impedance state. Then, in the initialization period, the first gradation output line LQPA and the second gradation output line LQPB for the positive polarity and the first gradation output line LQNA and the second gradation output line LQNB for the negative polarity are set to the initialization voltage VG0. Thereafter, the assist driving is performed by the assist circuit ASP or the assist circuit ASN. For example, in the positive polarity period, the assist driving of increasing the voltage of the first gradation output line LQPA and the second gradation output line LQPB from the initialization voltage VG0 to the voltage on the high potential side is performed. In addition, in the negative polarity period, the assist driving of reducing the voltage of the first gradation output line LQNA and the second gradation output line LQNB from the initialization voltage VG0 to the voltage on the low potential side is performed. Then, in an amplifier assist period after the assist period, the assist circuit ASAM for the amplifier circuit is operated. For example, in the positive polarity period, the assist circuit ASAM performs the assist driving of increasing the voltage of the second gradation output line LQPB (LQB) so as to bring the voltage of the second gradation output line LQPB (LQB) closer to the second gradation voltage VGPB. On the other hand, in the negative polarity period, the assist circuit ASAM performs the assist driving of reducing the voltage of the second gradation output line LQNB (LQB) so as to bring the voltage of the second gradation output line LQNB (LQB) closer to the second gradation voltage VGNB. After the amplifier assist period, the D/A converter circuit DACP or the D/A converter circuit DACN is operated to perform the DAC driving. For example, in the positive polarity period, the DAC driving of setting the voltage of the first gradation output line LQPA to the first gradation voltage VGPA, and setting the voltage of the second gradation output line LQPB to the second gradation voltage VGPB is performed. In addition, in the negative polarity period, the DAC driving of setting the voltage of the first gradation output line LQNA to the first gradation voltage VGNA, and setting the voltage of the second gradation output line LQNB to the second gradation voltage VGNB is performed.

By providing the assist circuit ASAM for the amplifier circuit in this manner, a small voltage difference between the first gradation voltage and the second gradation voltage can be generated at high speed. For example, in the positive polarity period, a small voltage difference between the first gradation voltage VGPA and the second gradation voltage VGPB can be generated at high speed by the assist driving of the assist circuit ASAM for the amplifier circuit. In the negative polarity period, a small voltage difference between the first gradation voltage VGNA and the second gradation voltage VGNB can be generated at high speed by the assist driving of the assist circuit ASAM for the amplifier circuit. Thus, higher speed driving of the display driver 10 can be achieved.

4. Electro-Optical Device, Electronic Apparatus, and Mobile Body

Figure 17:
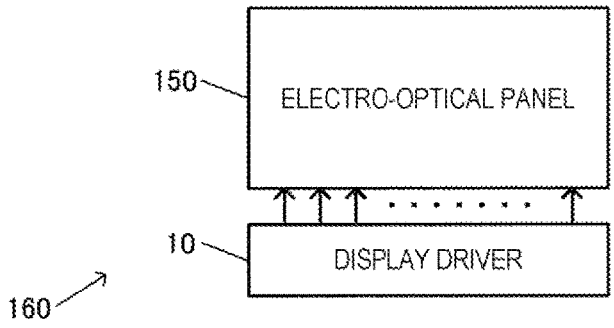
FIG. 17 is a configuration example of an electro-optical device.

FIG. 17 illustrates a configuration example of the electro-optical device 160 of the embodiment. The electro-optical device 160 includes the display driver 10 and the electro-optical panel 150 of the embodiment. For example, the display driver 10 is mounted on a flexible substrate, and the flexible substrate is coupled to the electro-optical panel 150 such that a data signal output terminal, which is the image signal output terminal of the display driver 10, and a data signal input terminal, which is the image signal input terminal of the electro-optical panel 150, are coupled through a line formed on the flexible substrate. Alternatively, the display driver 10 may be mounted on a rigid substrate, and the rigid substrate and the electro-optical panel 150 may be coupled through a flexible substrate such that the data signal output terminal of the display driver 10 and the data signal input terminal of the electro-optical panel 150 are coupled through a line formed on the flexible substrate.

Figure 18:
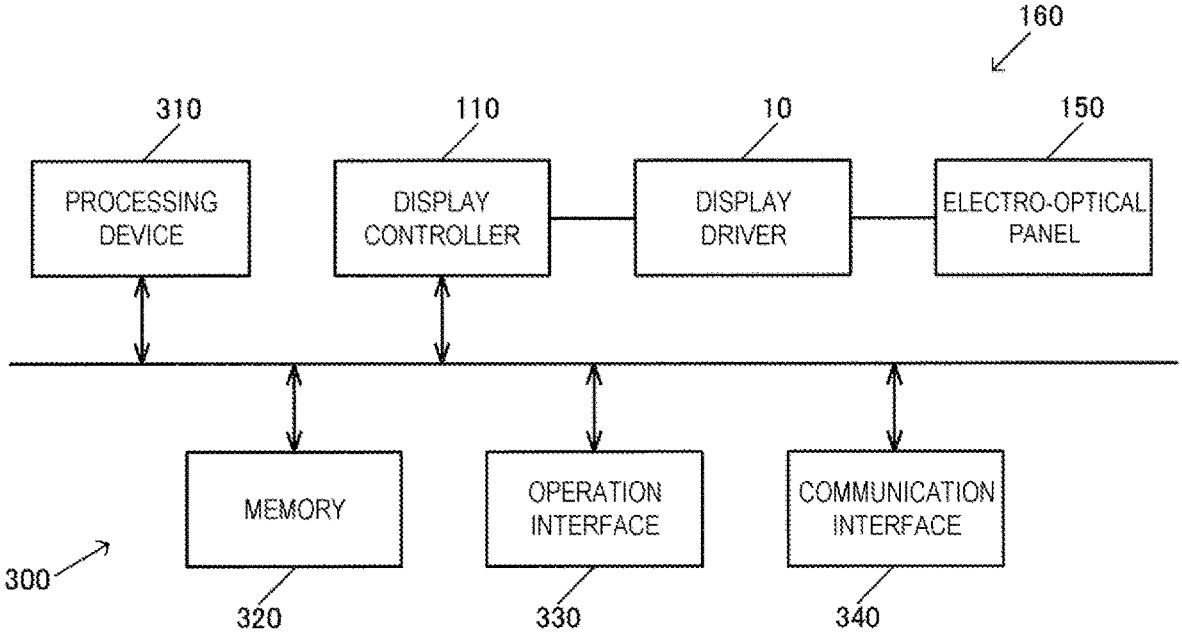
FIG. 18 is a configuration example of an electronic apparatus.

FIG. 18 illustrates a configuration example of an electronic apparatus 300 including the display driver 10 of the embodiment. The electronic apparatus 300 includes the display driver 10, the electro-optical panel 150, a display controller 110, a processing device 310, a memory 320, an operation interface 330, and a communication interface 340. The display driver 10, which is a circuit device, and the electro-optical panel 150 constitute the electro-optical device 160. Specific examples of the electronic apparatus 300 include various types of electronic apparatuses such as a projector, a vehicle-mounted device, a head-mounted display, a printing device, a mobile information terminal, a mobile game terminal, a robot, and an information processing device. The vehicle-mounted device is, for example, a panel apparatus such as a meter panel, or an electronic apparatus such as a car navigation system.

The display controller 110 performs various controls such as timing control of the display driver 10, supplies image data as display data to the display driver 10, and performs image processing on the image data. The processing device 310 performs control processing of the electronic apparatus 300 and various types of signal processing. The processing device 310 is, for example, a host that is an external device. The processing device 310 can be achieved with, for example, a processor such as a CPU and an MPU, an ASIC, or the like. The memory 320 stores data from the operation interface 330 and/or the communication interface 340 or functions as a work memory of the processing device 310, for example. The memory 320 can be achieved with, for example, a semiconductor memory such as a RAM and a ROM, and/or a magnetic storage device such as a hard-disc drive. The operation interface 330 is a user interface for receiving various operations from a user. For example, the operation interface 330 can be achieved with a button, a mouse, a keyboard, a touch panel installed in the electro-optical panel 150, or the like. The communication interface 340 is an interface for communications of image data and/or control data. The communication processing performed by the communication interface 340 may be wired communication processing or wireless communication processing.

In the case where the electronic apparatus 300 is a projector, a projection unit including a light source and an optical system is provided. The light source is achieved with a lamp unit including a white light source such as a halogen lamp, for example. The optical system is achieved with a lens, a prism, a mirror, or the like. In the case where the electro-optical panel 150 is of a transmissive type, light from the light source is applied to the electro-optical panel 150 through the optical system, and the light passed through the electro-optical panel 150 is projected to a screen. In the case where the electro-optical panel 150 is of a reflective type, light from the light source is applied to the electro-optical panel 150 through the optical system, and the light reflected by the electro-optical panel 150 is projected to a screen.

Figure 19:
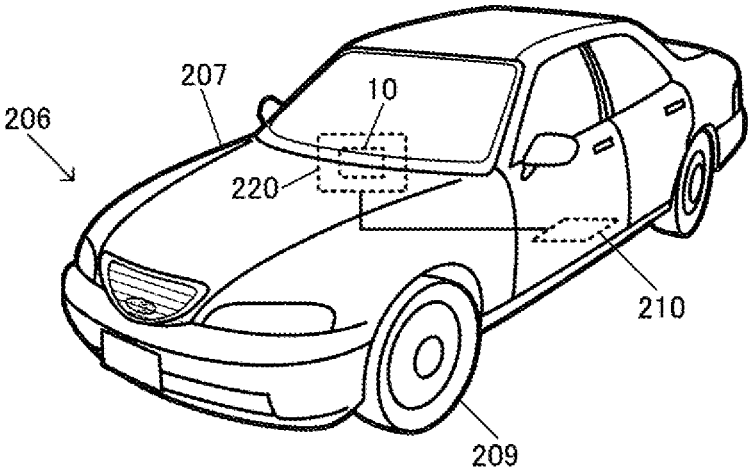
FIG. 19 is a configuration example of a mobile body.

FIG. 19 illustrates a configuration example of a mobile body including the display driver 10 of the embodiment. The mobile body is an apparatus or a device that moves on the ground, in the air, or on the sea, and includes a drive mechanism such as an engine and a motor, a steering mechanism such as a handle and a rudder, and various electronic apparatuses, for example. Examples of the mobile body of the embodiment include a vehicle, an airplane, a bike, a ship, and a robot, for example. FIG. 19 schematically illustrates an automobile 206 as a specific example of the mobile body. The automobile 206 includes a vehicle body 207 and a wheel 209. A display device 220 including the display driver 10 and a control device 210 for controlling each part of the automobile 206 are incorporated in the automobile 206. The control device 210 may include an electronic control unit (ECU), for example. The display device 220 is achieved with the electro-optical device 160, and is, for example, a panel device such as a meter panel. The control device 210 generates an image to be presented to the user and transmits the image to the display device 220. The display device 220 displays the received image on the display unit of the display device 220. For example, information such as vehicle speed, remaining fuel level, driving distance, and settings of various devices are displayed as images.

As described above, the display driver of the embodiment includes a D/A converter circuit configured to output a gradation voltage to an output line on a basis of display data, an assist circuit including a capacitor group and a drive circuit configured to output a drive signal group to a first end of the capacitor group on a basis of the display data, the assist circuit being coupled to the output line and configured to perform assist driving of the output line, and an amplifier circuit configured to drive an electro-optical panel. The assist circuit includes an output switch provided between a second end of the capacitor group and the output line, the output switch being configured to be turned on in an assist period, and an initialization switch including a first end coupled to the second end of the capacitor group and a second end to which an initialization voltage is input, and in an initialization period, the output switch and the initialization switch are turned on.

According to the embodiment, in the initialization period, the output switch and the initialization switch are turned on, and the other end of the capacitor group is set to the initialization voltage, and thus the output line is set to the initialization voltage. Thus, after the output line is set to the initialization voltage in the initialization period, the assist circuit can perform the assist driving in the assist period. In this manner, even in the case where the assist driving is repeatedly performed, the assist circuit can perform the assist driving with the initialization voltage as the starting voltage. Thus, it is possible to achieve a display driver that can maintain proper assist driving even in the case where the assist driving is repeatedly performed.

In addition, in the embodiment, an output of the D/A converter circuit may be set to a high impedance state in the initialization period.

In this manner, the D/A converter circuit does not output the gradation voltage to the output line in the initialization period, and thus the output line can be properly set to the initialization voltage.

In addition, in the embodiment, after the initialization period, the initialization switch may be turned off, and after the assist circuit performs the assist driving of the output line in the assist period, the output switch may be turned off.

In this manner, by turning off the initialization switch after the initialization period such that the initialization voltage is not supplied to the other end of the capacitor group, the assist circuit can perform the assist driving, and by turning off the power switch after the assist period, the assist driving of the output line by the assist circuit can be stopped.

In addition, in the embodiment, the D/A converter circuit may output the gradation voltage to the output line after the output switch is turned off.

In this manner, the output line is set to the initialization voltage in the initialization period, and the assist circuit performs the assist driving on the basis of the display data with the initialization voltage as the starting voltage, and thus, the voltage of the output line is brought closer to the gradation voltage output by the D/A converter circuit. Thereafter, the D/A converter circuit outputs the gradation voltage to the output line, and thus the electro-optical panel can be driven at a drive voltage corresponding to the gradation voltage.

In addition, in the embodiment, the assist circuit may include an initialization circuit configured to output a control signal group for initialization to the drive circuit in the initialization period, and to output the control signal group corresponding to the display data to the drive circuit in the assist period.

In this manner, in the initialization period, the initialization circuit outputs the control signal group for initialization to the drive circuit, and thus the driving circuit can output the drive signal group for initialization to one end of the capacitor group. Then, in the assist period, the initialization circuit outputs the control signal group corresponding to the display data to the drive circuit, and thus the drive circuit can output the drive signal group corresponding to the display data to one end of the capacitor group, and, the assist driving of bringing the voltage of the output line closer to the voltage corresponding to the display data can be achieved.

In addition, in the embodiment, a first gradation output line and a second gradation output line may be provided as the output line, the D/A converter circuit may output a first gradation voltage to the first gradation output line on a basis of upper bit data of the display data, and output a second gradation voltage to the second gradation output line on a basis of the upper bit data. The amplifier circuit may output a drive voltage corresponding to a gradation voltage between the first gradation voltage and the second gradation voltage on a basis of lower bit data of the display data.

In this manner, it suffices that the D/A converter circuit performs D/A conversion based on the upper bit data of the display data, and thus the resolution of the D/A conversion required for the D/A converter circuit can be reduced. The D/A conversion based on the lower bit data of the display data can be performed by the amplifier circuit, and thus the size of the D/A converter circuit can be reduced.

In addition, in the embodiment, the assist circuit may be coupled to the first gradation output line and the second gradation output line.

In this manner, even in the case where the first gradation output line and the second gradation output line are provided as output lines, the assist driving of both the first gradation output line and the second gradation output line can be performed by one assist circuit, and thus the size of the circuit can be reduced.

In addition, in the embodiment, an assist circuit for an amplifier circuit coupled to one of the first gradation output line and the second gradation output line may be provided. After assist driving of the first gradation output line and the second gradation output line is performed by the assist circuit, the assist circuit for the amplifier circuit may perform assist driving of the one of the first gradation output line and the second gradation output line.

In this manner, a small voltage difference between the first gradation voltage and the second gradation voltage can be generated at high speed by the assist driving of the assist circuit for the amplifier circuit, and thus higher speed driving of the display driver can be achieved.

In addition, the display driver of the embodiment includes a D/A converter circuit configured to output a gradation voltage to an output line on a basis of display data, an assist circuit including a capacitor group and a drive circuit configured to output a drive signal group to a first end of the capacitor group on a basis of the display data, the assist circuit being coupled to the output line and configured to perform assist driving of the output line, an amplifier circuit configured to drive an electro-optical panel, and an assist circuit for the amplifier circuit A first gradation output line and a second gradation output line are provided as the output line, the D/A converter circuit outputs a first gradation voltage to the first gradation output line on a basis of upper bit data of the display data, and outputs a second gradation voltage to the second gradation output line on a basis of the upper bit data The amplifier circuit outputs a drive voltage corresponding to a gradation voltage between the first gradation voltage and the second gradation voltage on a basis of lower bit data of the display data The assist circuit for the amplifier circuit is coupled to one of the first gradation output line and the second gradation output line, and, after the assist circuit sets the first gradation output line and the second gradation output line to an assist voltage, the assist circuit for the amplifier circuit performs assist driving of the one of the first gradation output line and the second gradation output line.

According to the embodiment, it suffices that the D/A converter circuit performs D/A conversion based on the upper bit data of the display data, and thus the resolution of the D/A conversion required for the D/A converter circuit can be reduced. The D/A conversion based on the lower bit data of the display data can be performed by the amplifier circuit, and thus the size of the D/A converter circuit can be reduced. In addition, according to the embodiment, a small voltage difference between the first gradation voltage and the second gradation voltage can be generated at high speed by the assist driving of the assist circuit for the amplifier circuit, and thus the high-speed driving of the display driver can be achieved.

In addition, the embodiment relates to an electro-optical device including the display driver, and the electro-optical panel.

In addition, the embodiment relates to an electronic apparatus including the display driver.

In addition, the embodiment relates to a mobile body including the display driver.

Although the embodiment has been described in detail above, those skilled in the art will easily understand that many modified examples can be made without substantially departing from novel items and effects of the present disclosure. All such modified examples are therefore included in the scope of the disclosure. For example, terms in the descriptions or drawings given even once along with different terms having identical or broader meanings can be replaced with those different terms in all parts of the descriptions or drawings. All combinations of the embodiment and modified examples are also included within the scope of the disclosure. The configurations, the operations, and the like of the display driver, the electro-optical device, the electro-optical panel, the electronic apparatus, the mobile body and the like are not limited to those described in the embodiment, and various modifications may be made.

What is claimed is:

1. A display driver comprising:

a D/A converter circuit configured to output a gradation voltage to an output line based on display data;

an assist circuit including a capacitor group and a drive circuit configured to output a drive signal group to a first end of the capacitor group based on the display data, the assist circuit being coupled to the output line and configured to perform assist driving of the output line, the assist circuit including:

an output switch provided between a second end of the capacitor group and the output line, the output switch being ON in an assist period; and an initialization switch including a first end coupled to the second end of the capacitor group and a second end to which an initialization voltage is input; and an amplifier circuit configured to drive an electro-optical panel, wherein in an initialization period, the output switch and the initialization switch are ON.

2. The display driver according to claim 1, wherein an output of the D/A converter circuit is set to a high impedance state in the initialization period.

3. The display driver according to claim 1, wherein after the initialization period, the initialization switch is turned off, and after the assist circuit performs the assist driving of the output line in the assist period, the output switch is turned off.

4. The display driver according to claim 3, wherein the D/A converter circuit outputs the gradation voltage to the output line after the output switch is turned off.

5. The display driver according to claim 1, wherein the assist circuit includes an initialization circuit configured to output a control signal group for initialization to the drive circuit in the initialization period, and to output the control signal group corresponding to the display data to the drive circuit in the assist period.

6. The display driver according to claim 1, wherein a first gradation output line and a second gradation output line are provided as the output line, the D/A converter circuit outputs a first gradation voltage to the first gradation output line based on upper bit data of the display data, and outputs a second gradation voltage to the second gradation output line based on the upper bit data, and the amplifier circuit outputs a drive voltage corresponding to a gradation voltage between the first gradation voltage and the second gradation voltage based on lower bit data of the display data.

7. The display driver according to claim 6, wherein the assist circuit is coupled to the first gradation output line and the second gradation output line.

8. The display driver according to claim 6, further comprising an assist circuit for an amplifier circuit coupled to one of the first gradation output line and the second gradation output line, wherein the assist circuit for the amplifier circuit, after the assist circuit performs assist driving of the first gradation output line and the second gradation output line, performs assist driving of the one of the first gradation output line and the second gradation output line.

9. An electro-optical device comprising:

the display driver according to claim 1; and the electro-optical panel configured to be driven by the display driver.

10. An electronic apparatus comprising the display driver according to claim 1.

11. A mobile body comprising the display driver according to claim 1.

* * * * *